US007939234B2

(12) United States Patent
Matsumoto et al.

(10) Patent No.: US 7,939,234 B2
(45) Date of Patent: May 10, 2011

(54) CARRIER FOR ELECTROSTATIC IMAGE DEVELOPMENT, AND IMAGE FORMATION METHOD AND APPARATUS

(75) Inventors: Akira Matsumoto, Kanagawa (JP); Akihiro Iizuka, Kanagawa (JP); Fusako Kiyono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 970 days.

(21) Appl. No.: 11/806,223

(22) Filed: May 30, 2007

(65) Prior Publication Data

US 2008/0081278 A1 Apr. 3, 2008

(30) Foreign Application Priority Data

Oct. 3, 2006 (JP) ..... 2006-271776

(51) Int. Cl.
*G03G 9/00* (2006.01)

(52) U.S. Cl. ..... 430/111.35; 430/119.88; 430/122.7; 430/111.4; 399/267

(58) Field of Classification Search ..... 430/111.35, 430/119.88, 122.7, 111.4; 399/267
See application file for complete search history.

(56) References Cited

U.S. PATENT DOCUMENTS

| | | | |
|---|---|---|---|
| 6,165,663 | A | 12/2000 | Baba et al. |
| 6,544,704 | B1 | 4/2003 | Matsuda et al. |
| 2002/0006567 | A1 | 1/2002 | Matsuda et al. |
| 2002/0160293 | A1 | 10/2002 | Takahashi et al. |
| 2002/0177061 | A1 | 11/2002 | Kobayashi et al. |
| 2003/0054279 | A1 | 3/2003 | Yamaguchi et al. |
| 2003/0091923 | A1 | 5/2003 | Kobayashi et al. |
| 2003/0186156 | A1 | 10/2003 | Kayamoto et al. |
| 2004/0253528 | A1 | 12/2004 | Yamashita et al. |
| 2005/0003292 | A1 | 1/2005 | Yamashita et al. |
| 2005/0079434 | A1 | 4/2005 | Suzuki et al. |
| 2005/0287463 | A1 | 12/2005 | Fukui et al. |
| 2006/0051695 | A1 | 3/2006 | Yuasa et al. |

FOREIGN PATENT DOCUMENTS

| | | |
|---|---|---|
| JP | A 60-131549 | 7/1985 |
| JP | A 02-064559 | 3/1990 |
| JP | A 05-066614 | 3/1993 |
| JP | A 5-100493 | 4/1993 |
| JP | A 07-234548 | 9/1995 |

(Continued)

OTHER PUBLICATIONS

Notice of Reasons for Rejection for Japanese Patent Application No. 2005-237879; mailed Mar. 16, 2010 (with translation).

(Continued)

*Primary Examiner* — Mark A Chapman
(74) *Attorney, Agent, or Firm* — Oliff & Berridge, PLC

(57) ABSTRACT

An image forming apparatus, including a latent image-holding member, a developing unit, a transfer unit, a cleaning unit, and a recycling unit, wherein the developer includes a toner having an external-additive adhesiveness index SA in the range of approximately 50% to approximately 95% and: a carrier containing magnetic particles and a coating layer coating the surface of the magnetic particles and having a total energy of approximately 1,420 to approximately 2,920 mJ; or a carrier containing magnetic powder-dispersed particles and a coating layer coating the surface of the magnetic powder-dispersed particles and having a total energy of, approximately 890 to approximately 1,390 mJ.

18 Claims, 4 Drawing Sheets

FOREIGN PATENT DOCUMENTS

| | | |
|---|---|---|
| JP | A 10-039547 | 2/1998 |
| JP | A 11-133672 | 5/1999 |
| JP | A 2001-330985 | 11/2001 |
| JP | A 2002-123042 | 4/2002 |
| JP | A 2002-328493 | 11/2002 |
| JP | A 2004-061730 | 2/2004 |
| JP | A 2004-170714 | 6/2004 |
| JP | A 2005-195728 | 7/2005 |
| JP | A-2005-257829 | 9/2005 |
| JP | A 2005-266564 | 9/2005 |
| JP | A-2006-084842 | 3/2006 |
| JP | A-2006-163235 | 6/2006 |
| JP | A-2006-171139 | 6/2006 |
| JP | A-2006-235588 | 9/2006 |
| JP | A 2006-323211 | 11/2006 |
| JP | A 2007-033720 | 2/2007 |
| JP | A 2007-033721 | 2/2007 |
| JP | A 2007-52283 | 3/2007 |
| JP | A 2007-114752 | 5/2007 |
| JP | A 2007-114766 | 5/2007 |

OTHER PUBLICATIONS

Jun. 4, 2010 Office Action issued in U.S. Appl. No. 11/313,208.

Apr. 5, 2010 Interview Summary issued in U.S. Appl. No. 11/313,208.

Mar. 24, 2010 Interview Summary issued in U.S. Appl. No. 11/313,208.

Oct. 19, 2009 Office Action issued in U.S. Appl. No. 11/313,208.

May 7, 2009 Office Action issued in U.S. Appl. No. 11/313,208.

Mar. 30, 2009 Advisory Action issued in U.S. Appl. No. 11/313,208.

Mar. 18, 2009 Interview Summary issued in U.S. Appl. No. 11/313,208.

Mar. 12, 2009 Interview Summary issued in U.S. Appl. No. 11/313,208.

Dec. 12, 2008 Office Action issued in U.S. Appl. No. 11/313,208.

Aug. 13, 2008 Office Action issued in U.S. Appl. No. 11/313,208.

May 21, 2008 Office Action issued in U.S. Appl. No. 11/313,208.

Office Action issued in JP Application No. 2006-271776 on Feb. 1, 2011 (with English translation).

VERTICAL LOAD (B) REVOLVING TORQUE

CARRIER FOR ELECTROSTATIC IMAGE DEVELOPMENT, AND IMAGE FORMATION METHOD AND APPARATUS

CROSS-REFERENCE TO RELATED APPLICATION

This application is based on and claims priority under 35 USC 119 from Japanese Patent Application No. 2006-271776 filed Oct. 3, 2006.

BACKGROUND OF THE INVENTION

1. Technical Field

The invention relates to a carrier for electrostatic image development, an image-forming method, and an image forming apparatus.

2. Background

Process for making image information visable via an electrostatic latent image, such as electrophotographic processes are currently used in various fields. In electrophotographic processes, an electrostatic latent image formed on a photoreceptor is developed with a developer containing a toner by charging and exposing, and the image is then made visable by transferring and fixing. The developers used in development include two-component developers, consisting of a toner and a carrier, and mono-component developers, such as magnetic toners in which a toner is used alone. The two-component developers, in which a carrier has the functions of agitating, conveying and charging the developer, i.e., functions different from that of the developer, have many advantageous characteristics and are currently widely used. In particular, developers containing a resin-coated carrier are superior in charge-controlling efficiency and allow easier improvements in environmental dependency and storability. For example, a cascade method has long been used for development, but recently a magnetic brush method, using a magnetic roll as a means of conveying the developer, is mainly used.

On the other hand, a so-called toner-reclaiming system, of feeding the toner recovered in cleaning as reused toner (hereinafter, referred to as "recycled toner") back into the developing device and reusing the toner as the developing toner, is attracting attention recently from the viewpoints of cost, energy conservation, and environmental safety, and toner-reclaiming systems with improved image quality by the addition of an external additive with a particular particle diameter and numerical ratio are known.

A method of controlling the shape and electrostatic properties of the toner in a toner-reclaiming system is also proposed. By the method, it is possible to prolong the usable period because of the improvement in mixing between the recycled toner and the carrier, due to an improvement of carrier fluidity, and also possible to prevent in-machine staining because of an increase in adhesiveness between the toner and the carrier by electrostatic force.

SUMMARY

According to an aspect of the invention, there is provided an image forming apparatus, comprising: a latent image-holding member; a developing unit that develops a latent image formed on the latent image-holding member into a toner image with a developer; a transfer unit that transfers the toner image formed on the latent image-holding member onto a recording medium; a cleaning unit that cleans off residual toner remaining on the latent image-holding member after transfer; and a recycling unit that recycles the cleaned residual toner by feeding it to the developing unit; and the developer comprising a toner having an external-additive adhesiveness index SA in the range of approximately 50% to approximately 95% and a carrier satisfying any one of the following conditions (A) or (B):

(A) the carrier includes magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,420 to approximately 2,920 mJ; or (B) the carrier includes magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 890 to approximately 1,390 mJ.

BRIEF DESCRIPTION OF THE DRAWINGS

Exemplary embodiments of the invention will be described in detail based the following FIGS., wherein.

DETAILED DESCRIPTION

Figure 1A:
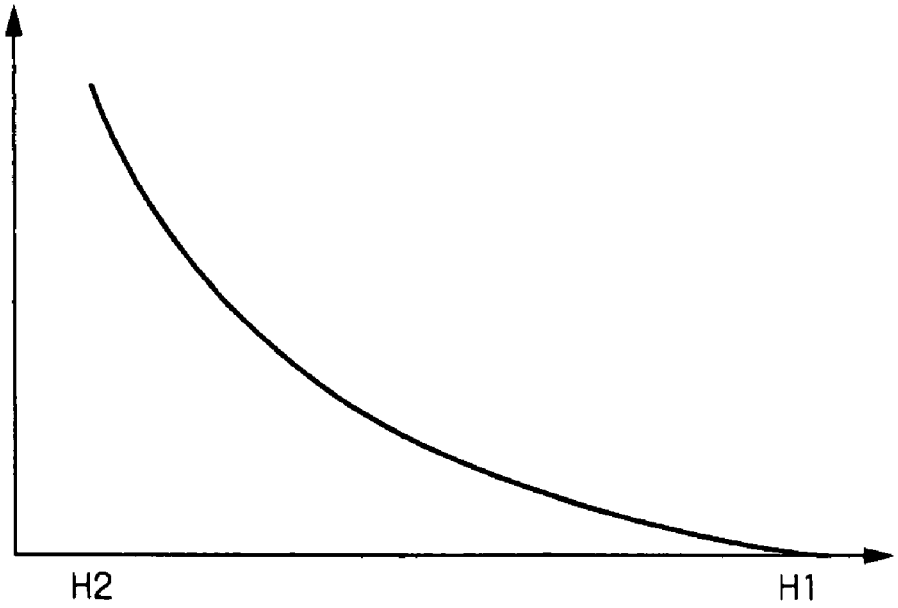
FIG. 1A is a graph showing the relationship between vertical load and the depth of the carrier layer contained in a measurement container.

A first image forming apparatus according to an aspect of the invention is an image forming apparatus, including a latent image-holding member, a developing unit that develops a latent image formed on a latent image-holding member into a toner image with a developer, a transfer unit that transfers the toner image formed on the latent image-holding member onto a recording medium, a cleaning unit that cleans the toner remaining on the latent image-holding member after transfer, and a recycling unit that recycles the residual toner by feeding it to the developing unit, and the developer comprising a toner having an external-additive adhesiveness index SA in the range of approximately 50% to approximately 95% and a carrier containing magnetic particles and a coating layer coating the surface of the magnetic particles and having a total energy thereof, as determined with a powder rheometer under the condition of a ventilation rate of 10 ml/min, a rotor-blade peripheral speed of 100 mm/s, and a rotor-blade angle of approach of −10°, in the range of approximately 1,420 to 2,920 mJ.

Another image forming apparatus according to an aspect of the invention is an image forming apparatus, including a latent image-holding member, a developing unit that develops a latent image formed on a latent image-holding member into a toner image with a developer, a transfer unit that transfers the toner image formed on the latent image-holding member onto a recording medium, a cleaning unit that cleans the toner remaining on the latent image-holding member after transfer, and a recycling unit that recycles the cleaned residual toner by feeding it to the developing unit, and the developer comprising a toner having an external-additive adhesiveness index SA in the range of approximately 50% to approximately 95% and a carrier containing magnetic powder-dispersed particles and a coating layer coating the surface of the magnetic powder-dispersed particles and the total energy thereof, as determined with a powder rheometer under the condition of a ventilation rate of 10 ml/min, a rotor-blade peripheral speed of 100 mm/s, and a rotor-blade angle of approach of −10°, is in the range of approximately 890 to 1,390 mJ.

The first and second aspects of the invention are common to each other, excepting in their carriers and developers, and thus, the common items therein will be described below together, with a phrase "according to the invention".

In an image-forming system using a recycled toner such as the toner-reclaiming system described below, the recycled toner pressurized in the cleaning step has toner fluidity and also electrostatic property reduced by toner deformation and embedding and release of the external additive, and thus, it is difficult to continue favorable image formation without change of the toner in the developer when the recycled toner is added to the developer. Thus, such a system demands that the fluidity of the developer does not change significantly, fundamentally when the recycled toner is mixed.

It is desirable to improve the fluidity of the carrier itself and also to prevent release of the external additive on the toner in the cleaning and recycling steps, to satisfy the requirements.

After intensive studies, the inventors have found that the total energy of the carrier in the developer, as determined with a powder rheometer under the condition of a ventilation rate of 10 ml/min, a rotor-blade peripheral speed of 100 mm/s, and a rotor-blade angle of approach of −10° had a strong correlation with the fluidity of the carrier when the recycled toner is added in the developing device.

It was also found that the external-additive adhesiveness index SA described below of the toner had a strong correlation with the fluctuation in toner fluidity during recycling.

It was also found that it was possible to reduce deterioration in the electrification amount of the toner in the developer when used in a toner-reclaiming system and to give a high-quality image continuously, by adjusting the total energy of the carrier, as determined with the powder rheometer, in the range specified above and also the external-additive adhesiveness strength SA of the toner in the range specified above.

Thus even in a toner-reclaiming system, it is possible to reduce deterioration of the electrification potential of developer and release of the external additive from the toner and thus, deterioration in transfer efficiency by low electrification in a developing device containing recycled toner. It is also possible to prevent print sample staining or in-machine staining, because the electrification amount is more uniform. The recycled toner was charged more favorably, because the fluidity of the developer was better, and thus, gave an image superior in density reproducibility, even when the image is printed continuously under high-temperature high-humidity condition.

Hereinafter, the carrier and the toner for developer according to an aspect of the invention will be described.

(Carrier)

The method of measuring the fluidity with a powder rheometer, an indicator in selecting the carrier in the invention, will be described first.

It is difficult to use conventional parameters such as particle diameter and surface roughness, in accurately determining the fluidity of particles, which is vulnerable to a greater number of factors than the fluidity of liquid, solid, or gas. In addition, it is even difficult to determine the measurement factor, because, even if a factor for fluidity is determined (for example, particle diameter, etc.), the factor may not influence on the fluidity in practice or only exerts an influence in combination with other factors.

In addition, the powder fluidity is influenced significantly by external environmental factors. For example, it varies significantly according to external environmental factors such as humidity and the condition of flowing gas. Even if obtained in a strictly controlled measuring condition, reproducibility of the values is still lower currently, because the influence of the external environmental factors on any measurement factor is not clearly understood.

For example, the angle of repose and the bulk density of toner particles have been used as the indicators for the fluidity of the toner particles when packed in a development tank, but these physical properties are indirectly related to the fluidity and thus, it was difficult to determine and control the fluidity quantitative.

However, it is only possible to determine the total energy applied from the carrier to the rotor blade of analyzer, i.e., sum of various factors influencing on fluidity, with a powder rheometer. Thus with a powder rheometer, it is possible to determine the fluidity directly, without determining the analytical items and identifying the optimal physical properties for the item of the carrier obtained while the surface physical properties and particle diameter distribution thereof are adjusted, as before. It is therefore possible to judge whether the carrier is suitable as the carrier for use in an electrostatic image developer, only by examining whether the value obtained with a powder rheometer is in a particular numerical range. The method of managing production of the carrier is extremely more practical than the methods of controlling the carrier fluidity with conventional indirect values. It is also easier to keep the measuring condition constant, and as a result, the reproducibility of measured values is higher.

In summary, the method of determining the fluidity with the value obtained with a powder rheometer is superior in simplicity, accuracy and reliability than conventional methods.

Hereinafter, the measuring method by using a powder rheometer will be described.

The powder rheometer is a fluidity analyzer determining fluidity directly by measuring the revolving torque of a rotor blade helically revolving in packed particles and the load applied on the rotor blade simultaneously. It is possible to detect fluidity reflecting the properties of the powder itself and the influence of external environment at high sensitivity, by determining the revolving torque and the load at the same time. It is also possible to obtain data higher in reproducibility, because the measurement is performed while the particle packing state is kept constant.

In the invention, FT4 manufactured by Freeman Technology was used as the powder rheometer for measurement. The carrier is stored under an environment at a temperature of 22° C. and a humidity of 50% RH for 8 hours before measurement for prevention of the error by external environmental factors during measurement.

A carrier is first packed in a 160-ml container having an internal diameter of 50 mm and a height of 88 mm to a carrier height of 88 mm. After packing, the packed carrier is conditioned (homogenized) before fluidity measurement, for prevention of fluctuation in measured values by change in packing condition. In the conditioning, the sample is brought into a homogeneous state, by rotating a rotor blade gently in the direction in which there is no resistance from the developer (in the direction opposite to the rotation direction during measurement) in the packed state so that no stress is give to the developer, while removing most of excessive air and partial stress. In a typical conditioning condition, the carrier is conditioned four times at an angle of approach of −5.0° and a rotor-blade peripheral speed of 60 mm/s.

The carrier that is above the top edge of the 160-ml container is scraped off after conditioning, and the carrier in the container is transferred into a 200-ml container having an internal diameter of 50 mm and a height of 140 mm. Then, measured are the revolving torque at a rotor-blade peripheral speed of 100 mm/sec and the load when the rotor blade is inserted into the packed carrier from a height from the bottom face of the container of 110 mm to 10 mm at an angle of approach of −10° under air flow at a ventilation rate of 10 ml/min. The rotation direction of the propeller is in the direction opposite to that during conditioning (clockwise when seen from above). The angle of approach is an angle between the axis of the analytical container and the rotating shaft of the rotor blade. The angle is set to −10°, because the angle has a strong correlation with the fluidity of the developer in the developing device.

Air is introduced at a rate of 10 ml/min to make the test condition resemble the flow state of the carrier in developing device. The ventilation rate of 10 ml/min reproduces the flow state of developer when a toner is added to the developing device. Flow of the ventilation air is controlled by FT4 manufactured by Freeman Technology.

Figure 1B:
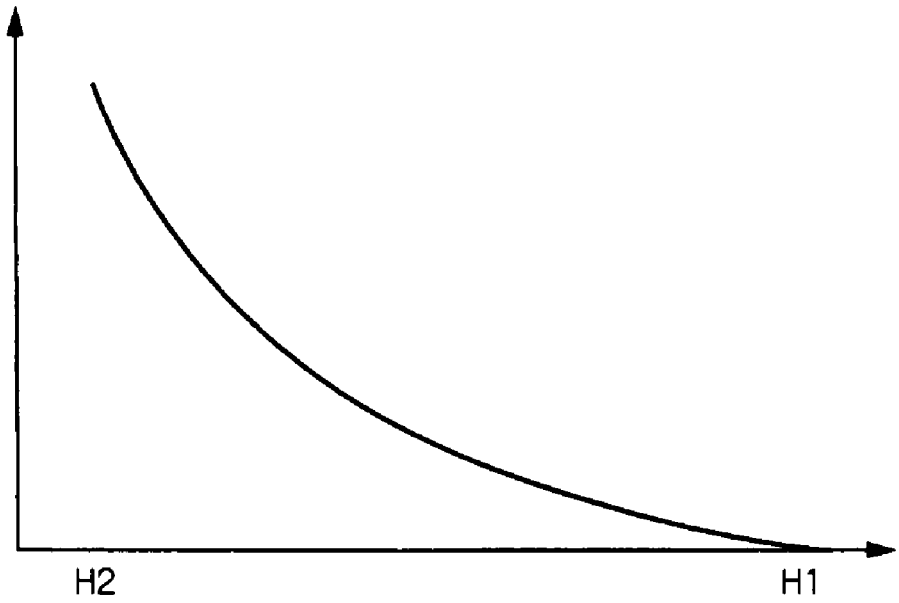
FIG. 1B is a graph showing the relationship between rotation torque and the depth of the carrier layer contained in a measurement container.
Figure 2:
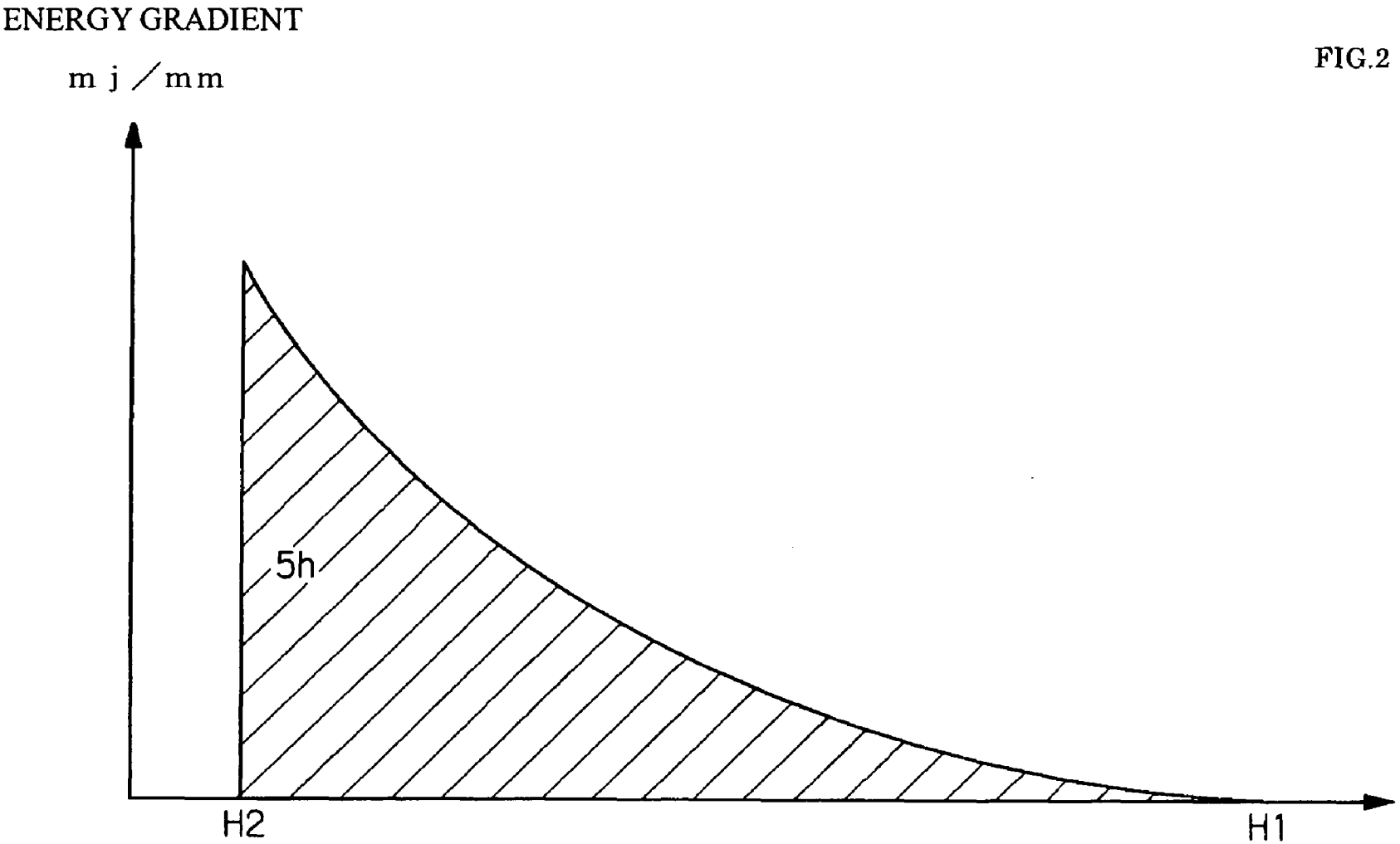
FIG. 2 is a graph showing the relationship between energy gradient obtained by the powder rheometer measurement and the depth of the carrier layer contained in a measurement container.

The relationships of the rotational torque and the load with the height from the bottom face H are shown in FIGS. 1(A) and 1(B). The energy gradient (mJ/mm) calculated from the rotational torque and the load is shown in FIG. 2, as it is plotted against the height H. The area obtained by integrating the energy gradient in FIG. 2 (hatched area in FIG. 2) is the total energy (mJ). In the invention, the total energy is obtained by integrating the energy gradient in the region at a height in the range of 10 to 110 mm from the bottom face.

To minimize the influence by error, an average value obtained by repeating the conditioning and energy measurement five times was used as the total energy (mJ) defined in the invention.

Figure 3:
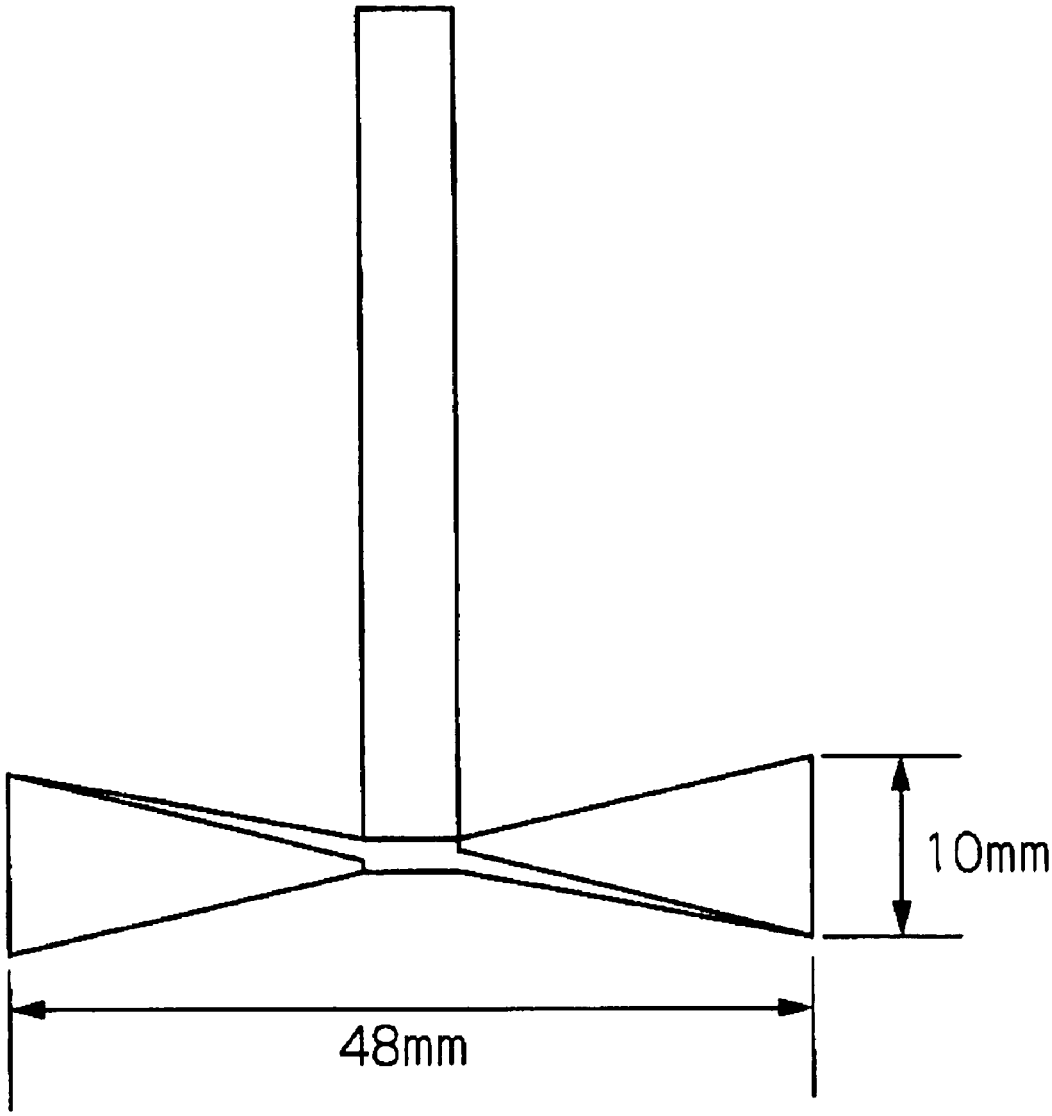
FIG. 3 is a view illustrating the rotor blade used in the powder rheometer.

The rotor blade used was a double-blade propeller-type blade of ϕ 48 mm diameter, 10 mm width shown in FIG. 3 that is manufactured by Freeman Technology.

Hereinafter, the composition of the carrier for use in the invention will be described. Specifically, the carrier for use in the first invention is a carrier having a magnetic particle as the core, and the carrier for use in the second invention is a carrier having a magnetic powder-dispersed particle as the core.

The carrier is not particularly limited, if it has a total energy, as determined by using the following powder rheometer, in the favorable numerical range below. Examples of the carriers include those containing carrier particles having a narrower diameter distribution, those having a coating layer on the carrier core surface made of a low-friction raw material, those in the spherical shape, and the like, and these carriers may be used alone or in combination.

-Carrier for Use in the Invention-

The carrier for use in the first invention contains magnetic particles and a coating layer coating the surface of the magnetic particles, and has a total energy, as determined with a powder rheometer under the condition of the properties above, in the range of approximately 1,420 to 2,920 mJ. A powder rheometer value of less than approximately 1,420 mJ means a toner that is lower in frictional efficiency and thus resistant to sufficient electrification. On the other hand, a carrier having measured value of approximately more than 2,920 mJ gives a less flowable developer and thus, leads to deterioration in the fluidity of recycled toner and prohibiting electrostatic electrification of the recycled toner to a degree favorable for image formation.

The total energy is preferably in the range of approximately 1,500 to approximately 2,700 mJ, more preferably in the range of approximately 1,600 to approximately 2,500 mJ.

Examples of the materials for the magnetic particle in the carrier for use in the first invention include magnetic metals such as iron, steel, nickel, and cobalt; alloys thereof with manganese, chromium, or a rare earth element (such as nickel-iron alloys, cobalt-iron alloys, and aluminum-iron alloys); magnetic oxides such as ferrite and magnetite; and the like, and magnetic oxides are favorable when a magnetic brushing method is used for development.

The volume-average diameter of the magnetic particles is preferably in the range of 10 to 500 μm, more preferably 30 to 150 μm, and still more preferably 30 to 100 μm. When used in an electrostatic image developer, magnetic particles having a volume-average diameter of less than 10 μm leads to increase in the adhesive force between toner and carrier and thus, possibly to deterioration in the toner-developing amount. On the other hand, with magnetic particles having a diameter of more than 500 μm, the resulting magnetic brush becomes uneven, prohibiting formation of a fine definite image.

The volume-average diameter of magnetic particles is a value, as determined by using a laser diffraction/scattering distribution analyzer (LS Particle Size Analyzer: LS13320, manufactured by Beckman Coulter). In measurement, 10 to 200 mg of a test sample was added to 2 ml of aqueous solution of a dispersant (surfactant), favorably 5% sodium alkylbenzenesulfonate. The mixture was added to 100 to 150 ml of purified water. The sample suspension was dispersed in an ultrasonic homogenizer for 1 minute, and the particle diameter distribution was determined with the analyzer described above at a pump speed of 80%.

A cumulative volume-average distribution curve is drawn from the small-diameter side with the data on particle size distribution obtained, and the particle diameter in the particle size range (channel) at a cumulative count of 50% is designated as volume-average diameter $D_{50v}$. Hereinafter, the same shall apply.

As for the particle diameter distribution of the magnetic particles, preferably, the ratio of volume-average particle diameter $D_{84v}$/volume-average particle diameter $D_{50v}$ is 1.20 or less, and the number-average particle diameter $D_{50p}$/number-average particle diameter $D_{16p}$, 1.25 or less; and more preferably, the ratio of volume-average particle diameter $D_{84v}$/volume-average particle diameter $D_{50v}$ is 1.15 or less, and the ratio of number-average particle diameter $D_{50p}$/number-average particle diameter $D_{16p}$, 1.20 or less.

A particle diameter distribution of magnetic particles wider than the range above may lead to a total energy, as determined by a powder rheometer, outside the favorable range above. On the other hand, a particle diameter distribution narrower than the range above may lead to difficulty in operation such as of classification and drastic deterioration of production efficiency.

When a volumetric cumulative distribution curve is drawn by plotting the particle diameter distribution, obtained by using a laser diffraction/scattering distribution analyzer (LS Particle Size Analyzer: LS13320, manufactured by Beckman Coulter), from the smallest-diameter side against partitioned particle diameter ranges (channels), and the particle diameter at a cumulative volume count of 84% is designated as $D_{84v}$; and, when a numerical cumulative distribution is drawn from the smallest-diameter side, and the particle diameter at a cumulative volume count of 50% is designated as $D_{50p}$ and the particle diameter at a cumulative volume count of 16%, as $D_{16p}$; coarse-particle-diameter distribution index and particle-diameter distribution index of the particle diameter distribution indices of the magnetic particles, are respectively represented by the volume-average particle diameter $D_{84v}$/volume-average particle diameter $D_{50v}$ and the number-average particle diameter $D_{50p}$/number-average particle diameter $D_{16p}$.

For preparation of magnetic particles satisfying the requirements in particle diameter distribution, a gravity classifier, a centrifugal classifier, an inertial classifier, or a screen separator is used for obtaining desirable particle diameter distribution.

Use of an air classifier is preferable for obtaining magnetic particles having a favorable particle diameter distribution, and in particular, particles and coarse particles are separated simultaneously by a single classification operation by the method.

The absolute specific gravity of the magnetic particle is preferably in the range of 3.0 to 8.0, more preferably 3.5 to 7.0, and 4.0 to 6.0. Magnetic particles having an absolute specific gravity of smaller than 3.0, which are similar to toner particles in the flowing state, may have a decreased electrification potential, and those having an absolute specific gravity of greater than 8.0 leads to deterioration in the fluidity of the carrier and increase of the total energy over the favorable upper limit.

The carrier for use in the first invention includes magnetic particles and a coating layer on the surface thereof. The coating layer is preferably a coating resin film of matrix resin.

Any one of common matrix resins may be used as the matrix resin. Examples thereof include polyolefin resins such as polyethylene and polypropylene; polyvinyl and polyvinylidene resins such as polystyrene, acrylic resins, polyacrylonitrile, polyvinyl acetate, polyvinylalcohol, polyvinylbutyral, polyvinyl chloride, polyvinylcarbazole, polyvinylether, and polyvinylketone; vinyl chloride-vinyl acetate copolymers; styrene-acrylic acid copolymers; organosiloxane bond-containing straight silicone resins or the derivatives thereof; fluoroplastics such as polytetrafluoroethylene, polyvinyl fluoride, polyvinylidene fluoride, and polychloro-trifluoroethylene; polyester; polyurethane; polycarbonate; phenol resins; amino resins such as urea-formaldehyde resins, melamine resins, benzoguanamine resins, urea resins, and polyamide resins; silicone resins; epoxy resins and the like.

These resins may be used alone or in combination of two or more.

In particular, for prevention of contamination of the toner components, use of a low-surface energy resin such as fluoroplastic or silicone resin as the coating resin is preferable, and coating with a fluoroplastic resin is more preferable.

Examples of the fluoroplastic resins include, but are not limited to, polyolefin fluoride, fluoroalkyl(meth)acrylate polymers and/or copolymers, vinylidene fluoride polymers and/or copolymers, and the mixtures thereof, and the like, and favorable examples of the fluorine-containing monomers for the fluoroplastic resins include fluorine-containing fluoroalkyl methacrylate monomers such as tetrafluoropropyl methacrylate, pentafluoromethacrylate, octafluoropentyl methacrylate, perfluorooctylethyl methacrylate, and trifluoroethyl methacrylate.

The amount of the fluorine-containing monomer blended is preferably in the range of 0.1 to 50.0 wt %, more preferably 0.5 to 40.0 wt %, and still more preferably 1.0 to 30.0 wt % with respect to the total monomers for the coating resin. A blending amount thereof of less than 0.1 wt % may lead to insufficient staining resistance, while a blending amount of more than 50.0 wt % to deterioration in adhesiveness of the coating resin to the core and thus, in the electrostatic property of the toner.

The amount of the matrix resin contained in the coating layer is preferably in the range of 0.5 to 10 wt %, more preferably 1.0 to 5.0 wt % and still more preferably 1.0 to 4.0 wt %, with respect to the total weight of the carrier. A blending amount of less than 0.5 wt % may result in easier exposure of the magnetic core particles on the carrier surface and deterioration of the electric resistance of the carrier. On the other hand, a blending amount of more than 10 wt % may lead to distinctive deterioration of carrier fluidity, prohibiting dispersion and electrification of the toner.

The coating layer may contain other resin particles as they are dispersed. Examples of the resin particles include thermoplastic resin particles, thermosetting resin particles, and the like. Among them, thermosetting resins, which raise the hardness of the toner relatively easily, are preferable, and use of a nitrogen atom-containing resin particles is preferable for providing the toner with a negative electrostatic property. These resin particles may be used alone or in combination of two or more.

The resin particles are preferably dispersed in the matrix resin uniformly in the coating-layer thickness direction and also in the direction tangent to the carrier surface. High compatibility between the resin of the resin particles and the matrix resin is favorable for improvement in dispersion of the resin particles in the coating resin layer.

Examples of the thermoplastic resins for the thermoplastic resin particles include polyolefin resins such as polyethylene and polypropylene; polyvinyl and polyvinylidene resins such as polystyrene, acrylic resins, polyacrylonitrile, polyvinyl acetate, polyvinylalcohol, polyvinylbutyral, polyvinyl chloride, polyvinylcarbazole, polyvinylether, and polyvinylketone; vinyl chloride-vinyl acetate copolymers; styrene-acrylic acid copolymers; organosiloxane bond-containing straight silicone resins or the derivatives thereof; fluoroplastics such as polytetrafluoroethylene, polyvinyl fluoride, polyvinylidene fluoride, and polychloro-trifluoroethylene; polyester; polyurethane; polycarbonate; and the like.

Examples of the thermosetting resins for the thermosetting resin particles include phenol resins; amino resins such as urea-formaldehyde resins, melamine resins, benzoguanamine resins, urea resins, and polyamide resins; silicone resins; epoxy resins; and the like.

The resin of resin particles and the matrix resin may be similar to or different from each other in composition. Particularly favorably, the resin of resin particles and the matrix resin are respectively made from different materials.

Use of a thermosetting resin as the resin of resin particles is preferable, as it improves the mechanical strength of the carrier. In particular, use of a resin having a crosslinked structure is preferable. Use of a resin allowing easier electrification of toner is favorable, to make the resin particles function as electrification sites more effectively, and the resin particles for use are preferably particles of a nitrogen-containing resin such as nylon resin, amino resin, or melamine resin.

The resin particles are prepared, for example, by a method of producing granulated resin particles by polymerization such as emulsion or suspension polymerization, a method of producing resin particles by dispersing monomers or oligomers in a solvent and granulating the resulting polymer while allowing crosslinking reaction simultaneously, or a method of producing resin particles by mixing low-molecular weight components and a crosslinking agent, for example by melt-blending, and pulverizing the resulting resin into particles having a particular diameter by pneumatic or mechanical force.

The volume-average diameter of the resin particles is preferably in the range of about 0.1 to about 2.0 μm, more preferably about 0.2 to about 1.0 μm. A volume-average diameter of less than 0.1 μm may lead to deterioration in dispersion of the particles in the coating layer, while an average diameter of more than 2 μm to easier separation of the particles from the coating layer and fluctuation in the electrostatic property. The volume-average diameter of resin particles is determined in a similar manner to the volume-average diameter of magnetic particles.

The resin particle are preferably contained in the coating layer in an amount in the range of about 1 to about 50 vol %, more preferably about 1 to about 30 vol %, and still more preferably about 1 to about 20 vol %. A content of the resin particles in coating layer at less than 1 vol % is undesirable, as it leads to insufficient effect of adding the resin particles, while a content of more than 50 vol % is also undesirable, as it leads to easier separation of the particles from the coating resin layer and fluctuation in the electrostatic property.

The coating layer may contain conductive powders (having a volumetric resistivity of about $10^{11}$ Ωcm or less) additionally.

Examples of the conductive powders include metals such as gold, silver and copper; carbon black; metal oxides such as titanium oxide, magnesium oxide, zinc oxide, aluminum oxide, calcium carbonate, aluminum borate, potassium titanate, and calcium titanate powder; powders surface-covered with tin oxide, carbon black, or a metal such as titanium oxide, zinc oxide, barium sulfate, aluminum borate, and potassium titanate powder; and the like. These substances may be used alone or in combination of two or more.

The conductive powder of the material described above may be treated with a coupling agent additionally. The coupling agent-treated conductive powder can be prepared, for example, by dispersing an untreated conductive powder in a solvent such as toluene, adding a coupling agent, allowing reaction between them, and drying the resulting powder under reduced pressure.

The coupling agent-treated conductive powder may be pulverized in a pulvelizer additionally for removal of the aggregate. Any one of known pulverizers including pin mill, disk mill, hammer mill, centrifugal mill, roller mill, jet mill, and the like may be used favorably as the pulverizer, and use of a jet mill is particularly preferable. Examples of the coupling agents favorably used include known coupling agents such as silane-coupling agents, titanium coupling agents, aluminum coupling agents, and zirconium coupling agents.

The volume-average diameter of the conductive powder is preferably 0.5 μm or less, more preferably 0.05 μm to 0.45 μm, and still more preferably 0.05 μm to 0.35 μm. The volume-average diameter of the conductive powder is determined in a similar manner to the volume-average diameter of magnetic particles.

A volume-average diameter of the conductive powder at more than 0.5 μm may lead to easier separation of the powder from the coating layer and thus larger fluctuation in electrostatic property.

The conductive powder is contained in the coating layer, normally in an amount of 1 to 80 vol %, preferably 2 to 20 vol %, and still more preferably 3 to 10 vol %.

The coating layer is formed on the surface of magnetic particles, for example, by an immersion method of preparing a coating layer-forming solution containing the resin, a conductive material and a solvent and immersing the magnetic particles therein, a spraying method of spraying a coating layer-forming solution on the surface of magnetic particles, a fluidized-bed method of spraying a coating layer-forming solution as the magnetic particles are floated with fluidizing air, or a kneader coater method of mixing magnetic particles and a coating layer-forming solution and removing the solvent in a kneader coater.

The solvent for use in preparing the coating layer-forming solution is not particularly limited, if it dissolves the resin, and examples thereof include aromatic hydrocarbons such as toluene and xylene, ketones such as acetone and methylethylketone, ethers such as tetrahydrofuran and dioxane, and the like.

The average thickness of the coating layer is preferably in the range of 0.1 to 10 μm, more preferably 0.1 to 3.0 μm, and more preferably 0.1 to 1.0 μm. An average coating-layer thickness of less than 0.1 μm may results in deterioration in resistance by separation of the coating layer during continuous use for a long term, while an average thickness of more than 10 μm unfavorable leads to elongation of the period until saturated electrification.

The absolute specific gravity of the carrier for use in the first invention containing magnetic particles that are coated, for example, with a resin on the surface is preferably in the range of 3.0 to 8.0, more preferably 3.5 to 7.0, and still more preferably 4.0 to 6.0. Unfavorably, magnetic particles having an absolute specific gravity of smaller than 3.0, which are similar to toner particles in the flowing state, may have a decreased electrification potential, while those having an absolute specific gravity of greater than 8.0 leads to deterioration in the fluidity of the carrier and increase of the total energy over the favorable upper limit.

In addition, the shape factor SF1 represented by the following Formula (1) of the carrier for use in the first invention is preferably 130 or less, more preferably 120 or less. A carrier having a shape factor SF1 closer to 100 is more spherical. A carrier having a larger shape factor SF1 is less flowable, because of collision among the carriers due to difference in shape. Thus, a shape factor SF1 of more than 130 leads a total energy higher than the favorable upper limit.

$$SF1=(ML^2/A)\times(\pi/4)\times 100 \qquad \text{Formula (1)}$$

In Formula (1), ML represents the absolute maximum length of a carrier particle, and A represents the projection area of the carrier particle.

The average of shape factors SF1 is determined by incorporating images of 50 carrier particles obtained at a magnification of 250 times under an optical microscope into an image-analyzing instrument (trade name: LUZEX III, manufactured by Nireco Corporation), measuring the maximum length and the projected area of each particle, calculating the SF1 of each particle, and obtaining the average thereof.

The saturation magnetization of the carrier for use in the first invention is preferably 40 emu/g or more, more preferably 50 emu/g or more.

A vibrating-sample magnetometer VSMP10-15 (manufactured by Toei Industry) is used for measurement of the magnetic properties. A test sample is placed in a cell having an internal diameter of 7 mm and a height of 5 mm, and the cell is fixed in the magnetometer above. Measurement is performed under an applied magnetic field at an intensity of up to the maximum 1,000 oersteds. A hysteresis curve is drawn on recording paper while the applied magnetic field is reduced, and the saturation magnetization, residual magnetization, tenacity, and others are determined from the data in the curve.

In the invention, the saturation magnetization is a magnetization determined in a magnetic field at 1,000 oersteds.

The carrier resistance (volumetric resistivity) is preferably controlled in the range of $1\times10^{8}$ to $1\times10^{14}$ Ωcm, more preferably $1\times10^{8}$ to $1\times10^{13}$ Ωcm, and still more preferably $1\times10^{8}$ to $1\times10^{12}$ Ωcm.

A carrier having a carrier resistance of more than $1\times10^{14}$ Ωcm is less active as a developing electrode during development, resulting in deterioration in solid reproducibility, for example by emergence of edge effect, particularly in painted image areas. On the other hand, a carrier having a resistance of less than $1\times10^{8}$ Ωcm leads to a problems of the development of the carrier itself by injection of electric charge from the developing roll to the carrier when the concentration of the toner in developer is decreased.

The carrier resistance (Ω·cm) was determined in the following manner: As for the measurement environment, the temperature was 20° C., and the humidity, 50% RH.

A carrier to be tested was first placed on the surface of a circular jig carrying an electrode plate having an area of 20 $cm^2$, forming a carrier layer at a thickness of approximately 1 to 3 mm. An electrode plate in the same shape having an area of 20 $cm^2$ was placed thereon, holding the carrier layer inside. A load of 4 kg was then applied onto the electrode plate mounted on the carrier layer for removal of voids in the carrier layer, and the thickness (cm) of the carrier layer was then determined. Specifically, the electrodes on the top and bottom of the carrier layer were connected to a high-pressure power-generating device; a high voltage of $10^{3.8}$ V/cm was applied between the electrodes; and the current (A) flowing then was determined directly, for calculation of the carrier resistance (Ω·cm). The carrier resistance (Ω·cm) was calculated according to the following Formula (2):

$$R=E\times20/(I-I_0)/L \qquad \text{Formula (2)}$$

In the Formula, R represents carrier resistance (Ω·cm), E represents applied voltage (V), I represents current (A), $I_0$ represents the current (A) at an applied voltage of 0 V; and L represents the thickness (cm) of the carrier layer. The coefficient 20 represents the area of the electrode plate ($cm^2$).

-Carrier for Use in Another Aspect of the Invention-

The carrier for use in a second invention includes magnetic powder-dispersed particles and a coating layer coating the surface of the magnetic powder-dispersed particles, and has a total energy, as determined with a powder rheometer under the condition of the properties above, in the range of approximately 890 to 1,390 mJ. A carrier having a powder rheometer-measured value in the range of approximately 890 to 1,390 mJ is more flowable when used for development of an electrostatic image, and readily mixed with the recycled toner. As a result, the recycled toner retains its favorable electrostatic property and thus, prevents image defects such as deposition of the toner blown out of the developing device on recording paper.

A carrier having a powder rheometer-measured value of smaller than approximately 890 mJ is lower in frictional effect, and prohibits sufficient electrification of the toner. On the other hand, a carrier having a value of approximately more than 1,390 mJ is leas flowable, leading to deterioration in the fluidity of reclaimed toner and prohibiting electrification of the recycled toner to a degree needed for forming a favorable image. The total energy is preferably in the range of 1,000 to 1,300 mJ, more preferably in the range of 1,100 to 1,200 mJ.

The core of the carrier for use in the second invention is a magnetic powder-dispersed particle containing a magnetic powder dispersed in a resin.

Any one of the magnetic substances described above for the magnetic particles may be used as the magnetic powder, and among them, iron oxide is preferable. Iron oxide particles, when used as the magnetic powder, give favorable properties.

These magnetic powders may be used alone or in combination of two or more.

The particle diameter of the magnetic powder is preferably in the range of 0.01 to 1 μm, more preferably 0.03 μm to 0.5 μm, and still more preferably 0.05 μm to 0.35 μm. A magnetic powder having a particle diameter of less than 0.01 μm may lead to deterioration in saturation magnetization or to increase in the viscosity of the composition (monomer mixture), prohibiting production of a carrier uniform in particle diameter. On the other hand, a magnetic powder having a particle diameter of more than 1 μm is lower in homogeneity.

The content of the magnetic powders in a magnetic powder-dispersed particle is preferably in the range of 30 to 95 wt %, more preferably 45 to 90 wt %, and still more preferably 60 to 90 wt %. A content of less than 30 wt % may lead, for example, to scattering of the magnetic substance-dispersed carrier, while a content of more than 95 wt % to hardening of the edges of the magnetic substance dispersion carrier, which may in turn lead to easier cracking.

Examples of the resin components (matrices) in the magnetic powder-dispersed particle include crosslinked styrene resins, acrylic resins, styrene-acrylic resin copolymers, phenol resins, and the like.

The magnetic powder-dispersed particle may contain other components, in addition to the matrix and the magnetic powder according to applications. Examples of the other components include antistatic agent, fluorine-containing particle, and the like.

As for the particle diameter distribution of the magnetic powder-dispersed particles, preferably, the ratio of volume-average particle diameter $D_{84v}$/volume-average particle diameter $D_{50v}$ is 1.20 or less and the ratio of number-average particle diameter $D_{50p}$/number-average particle diameter $D_{16p}$, 1.25 or less; and more preferably, the ratio of volume-average particle diameter $D_{84v}$/volume-average particle diameter $D_{50v}$ is 1.15 or less and the ratio of number-average particle diameter $D_{50p}$/number-average particle diameter $D_{16p}$, 1.20 or less.

The magnetic powder-dispersed particles are prepared, for example, by a melt blending method of melt-bending a magnetic powder and an insulating resin such as styrene-acrylic resin for example in Banbury mixer or kneader and then cooling, pulverizing and classifying the resulting resin (see, for example, Japanese Patent Application Publication (JP-B) Nos. 59-24,416 and 8-3,679), a suspension polymerization method of preparing a suspension by dispersing a binder resin monomer unit and a magnetic powder in a solvent and allowing polymerization of the suspension (Japanese Patent Application Laid-Open (JP-A) No. 5-100,493, etc.), or a spray-drying method of mixing and dispersing a magnetic powder in a resin solution and spraying and drying the mixture.

The melt-blending, suspension polymerization and spray-drying methods above include steps of preparing a magnetic powder previously by any means, mixing the magnetic powder with a resin solution, and thus, dispersing the magnetic powder in a resin solution.

In producing the magnetic powder-dispersed particles by the melt-blending method, it is possible to adjust the particles to a desirable particle diameter distribution by classifying the particles with a centrifugal classifier, an inertial classifier, or a sieve.

In producing the magnetic powder-dispersed particles by the suspension polymerization method, it is quite important to control the dispersed particle diameter and thus, to adjust the temperature, the amount and kind of surfactant, the speed and period of agitation and others during dispersion, to obtain favorable particle diameter distribution.

The volume-average diameter of the magnetic powder-dispersed particles in the carrier for use in the second present invention is preferably in the range of 10 to 500 μm, more preferably 30 to 150 μm, and still more preferably 30 to 100 μm. When the volume-average diameter is less than 10 μm, the carrier easily migrates onto the photosensitive body, and also, the particles are more difficult to produce; while magnetic powder-dispersed particles having a volume-average diameter of more than 500 μm are also undesirable, because the particles give a toner possibly leading to a roughened image containing lines of carrier called brush mark.

The volume-average diameter of the magnetic powder-dispersed particles is determined in a similar manner to that when the core is magnetic particle.

The absolute specific gravity of the magnetic powder-dispersed particles is preferably in the range of 2.0 to 5.0, more preferably 2.5 to 4.5, and still more preferably 3.0 to 4.0. Magnetic powder-dispersed particles having an absolute specific gravity of smaller than 2.0, which are similar to toner particles in the flowing state, may have a decreased electrification potential, and those having an absolute specific gravity of greater than 5.0 leads to deterioration in the fluidity of the carrier and increase of the total energy over the favorable upper limit.

The materials for the coating layer formed on the surface of magnetic particles in the first invention described above may be used for the coating layer formed on the surface of the magnetic powder-dispersed particles, and favorable materials are also the same. In addition, the substances contained in the coating layer and the method of forming the coating layer are also the same as those for the coating layer on the magnetic particles.

The absolute specific gravity of the carrier for use in the second invention having a coating layer on the surface of magnetic powder-dispersed particles is preferably in the range of 2.0 to 5.0, more preferably 2.5 to 4.5 and still more preferably 3.0 to 4.0. A carrier having an absolute specific gravity of smaller than 2.0, which are similar to toner particles in the flowing state, may have a decreased electrification potential, and those having an absolute specific gravity of greater than 5.0 leads to deterioration in the fluidity of the carrier and increase of the total energy over the favorable upper limit.

The shape factor SF1 represented by Formula (1) above of the carrier for use in the second invention is preferably 150 or less, more preferably 130 or less. The shape factor SF1 of the carrier is determined in a similar manner to the carrier for use in the first invention.

The saturation magnetization of the carrier for use in the second invention is preferably 40 emu/g or more, more preferably 50 emu/g or more. The magnetic properties of the carrier are also determined in a similar manner to the carrier for use in the first invention.

The carrier resistance (volumetric resistivity) is preferably controlled in the range of $1\times10^{7}$ to $1\times10^{14}$ Ωcm, more preferably $1\times10^{8}$ to $1\times10^{13}$ Ωcm, and still more preferably $1\times10^{8}$ to $1\times10^{12}$ Ωcm. A carrier having a carrier resistance of more than $1\times10^{14}$ Ωcm is less active as a developing electrode during development, resulting in deterioration in solid reproducibility, for example by emergence of edge effect, particularly in painted image areas. On the other hand, a carrier resistance of less than $1\times10^{7}$ Ωcm leads to a problem of the development of the carrier itself by injection of electric charge from the developing roll to the carrier when the concentration of the toner in developer is decreased.

The carrier resistance (Ω·cm) of carrier is also determined in a similar manner to the carrier for use in the first invention.

(Toner)

Hereinafter, the toner for use in the invention will be described.

The toner contains toner particles containing a binder resin and a colorant as its principal components and an external additive processed on the surface thereof.

Examples of the binder resins include homopolymer or copolymers of monoolefins such as ethylene, propylene, butylene and isoprene; vinyl esters such as vinyl acetate, vinyl propionate, vinyl benzoate, and vinyl butyrate; α-methylene fatty monocarboxylic esters such as methyl acrylate, phenyl acrylate, octyl acrylate, methyl methacrylate, ethyl methacrylate, butyl methacrylate, and dodecyl methacrylate; vinyl ethers such as vinylmethylether, vinylethylether, and vinylbutylether; vinylketones such as vinylmethylketone, vinylhexylketone, and vinyl isopropenylketone; and others and the like. Particularly favorable resins among them include polystyrene, styrene-alkyl acrylate copolymers, styrene-butadiene copolymers, styrene-maleic anhydride copolymers, polystyrene, polypropylene and the like. Also favorable are polyester, polyurethane, epoxy resins, silicone resins, polyamide, modified rosins and the like.

The colorant is not particularly limited, and examples thereof include carbon black, aniline blue, Calco oil blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, Pigment Blue 15:3, and the like.

An antistatic agent may be added as needed to the toner particles. When added to a color toner, the antistatic agent is preferably a colorless or pale colored antistatic agent that does not affect the color of the toner. Any known agent may be used as the antistatic agent, and favorable examples thereof include azo-based metal complexes, metal complexes or salts of salicylic acid or an alkylsalicylic acid, and the like.

The toner particle may contain additionally other known components including offset inhibitor such as a low-molecular weight polypropylene, low-molecular weight polyethylene, or wax as releasing agents. Favorable examples of the waxes include paraffin waxes and the derivatives thereof, montan waxes and the derivatives thereof, microcrystalline waxes and the derivatives thereof, Fischer-Tropsch waxes and the derivatives thereof, polyolefin waxes and the derivatives thereof, and the like. The derivatives include oxides, polymers with a vinyl monomer, graft-modified derivatives, and the like. Alternatively, other substances such as alcohols, fatty acids, vegetable waxes, animal waxes, mineral waxes, ester waxes, acid amides, and the like may be used.

In addition, inorganic particles may be added internally to the toner particle, for example, for making oil-less fixing easier. Use of inorganic particles having a refractive index smaller than that of the toner binder resin is preferable, to obtain an OHP sheet superior in light transmittance. An excessively larger refractive index may result in increase in turbidity even in a common image. Typical examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

In particular among them, silica and titania particles are favorable. The silica particles may be particles containing anhydrous silica, aluminum silicate, sodium silicate, potassium silicate, and the like, but the composition thereof is preferably so adjusted that the silica particles has a refractive index of 1.5 or less.

These inorganic particles may be previously hydrophobilized on the surface. The hydrophobilization treatment improves the dispersion efficiency of the inorganic particles in toner particles, and makes the toner resistant to environmental fluctuation of electrification and also to carrier staining, even when the inorganic particles embedded in the toner are exposed on the toner particle surface. The hydrophobilization treatment may be performed, for example, by immersing the inorganic particles in a hydrophobilizing agent. The hydrophobilizing agent is not particularly limited, and examples thereof include silane coupling agents, silicone oils, titanate coupling agents, aluminum coupling agents, and the like. These compounds may be used alone or in combination of two or more. Among them, silane coupling agents are favorable.

The amount of the hydrophobilizing agent used may vary, for example, according to the kind of the inorganic particles, and is not particularly limited, but favorably, normally in the range of 5 to 50 wt parts with respect to 100 wt parts of the inorganic particles.

The method of producing the toner is not particularly limited, and examples thereof include a blending pulverizing method of blending a binder resin, a colorant, a releasing agent, and as needed an antistatic agent and others and pulverization and classification the resulting compound; a method of converting the shape of the particles obtained by the blending pulverizing method by mechanical impulsive force or heat energy; an emulsion polymerization aggregation method of obtaining toner particles by forming a dispersion by emulsion-polymerization of a polymerizable monomer for the binder resin, mixing the dispersion with a colorant, a releasing agent, and as needed an antistatic agent and others, and allowing aggregation and thermal fusion of the particles therein; a suspension polymerization method of suspending a solution containing a polymerizable monomer for the binder resin, a colorant, a releasing agent, and as needed an antistatic agent and others in an aqueous solvent, and allowing polymerization of the monomer therein; a dissolution suspension method of obtaining toner particles by suspending a solution containing a binder resin, a colorant, a releasing agent, an as needed an antistatic agent and others in an aqueous solvent and granulating the ingredients therein; and the like.

The volume-average diameter of the toner is preferably in the range of 2 to 12 μm, more preferably 3 to 9 μm.

The shape factor SF1 of the toner is preferably in the range of approximately 100 to 125, more preferably in the range of approximately 100 to 120. When the shape factor SF1 is in the range of approximately 100 to 125, it is possible to obtain favorable transfer efficiency and reduce the overall amount of the recycled toner, and also to form a high-quality image without deterioration in electrification potential of the toner in that state, even though the recycle condition of the toner should be controlled strictly.

The shape factor SF1 of toner is a value represented by the following Formula (3):

$$SF1=(ML^2/4A)\times(\pi/4)\times 100 \qquad \text{Formula (3)}$$

In Formula (3), ML represents the absolute maximum length of the toner, and A represents the projection area of the toner.

The absolute maximum length and the projection area of a toner represented by Formula (3) are determined by taking an image of the toner under an optical microscope (Microphoto-FXA, manufactured by Nikon Corporation) at a magnification of 500 times and analyzing the image information obtained by sending it via an interface, for example, to an image-analyzing instrument (LUZEX III) manufactured by Nicolet Corporation. The shape factor SF1 is determined as the average after measurement of randomly sampled 1,000 toner particles.

The external additive deposited on the toner particle surface is not particularly limited, but preferably inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$ and the like. Among them, silica particles and titania particles are particularly favorable, because the toner containing the particles are more flowable.

Thus, use of $SiO_2$ or $TiO_2$ is favorable, for making the recycled toner retain favorable fluidity.

The toner for use in the invention should have an external-additive adhesiveness index SA in the range of approximately 50% to approximately 95%. The external-additive adhesiveness index SA is an indicator of the adhesiveness of the external additive to the toner surface against external stimulus, and a larger numerical value means that the external additive is bound to the toner surface more tightly. The external-additive adhesiveness index SA is more preferably in the range of 60 to 90% and still more preferably 70 to 90%. When the external-additive adhesiveness index SA is less than 50%%, the external additive is released easily from the toner, leading to decrease in the amount of the external additive on the recycled toner and thus to decrease in the electrification potential. It is practically difficult to produce a toner having an external-additive adhesiveness index of more than approximately 95%.

The external-additive adhesiveness index SA can be determined by determining the total amount of the added external additives quantitatively by irradiating fluorescence X ray on the molded toner, dispersing the toner in a triton solution [0.2 wt % aqueous solution of polyoxyethylene (10) octylphenylether (manufactured by Wako Pure Chemical Industries)], ultrasonicating the dispersion (output: 20 W, frequency: 20 kHz) for 1 minute, collecting the toner by filtration, remolding the toner, determining quantitatively the amount of the external additive remaining on the toner by irradiation of fluorescence X ray once again, and calculating the amount as a rate to the total amount of the external additives.

It is possible to adjust the external-additive adhesiveness index SA in the favorable range above, for example, by a method of mechanically mixing the toner particles and the external additive for deposition or allowing deposition of the external additive by heat treatment, but the mechanical mixing/deposition method is favorable, because the processing is completed in a shorter period of time. Use of a high-shearing force apparatus is desirable then, and, for example, when a powder-processing apparatus Nobilta (manufactured by Hosokawamicron) is used, it is possible to obtain the favorable adhesiveness described above, by processing under the condition of a clearance of 1 mm to 5 mm and a rotational velocity of 1,000 to 5,000 rpm.

The amount of the external additive used in processing the toner particles (addition amount) is preferably in the range of 0.1 to 5.0 wt parts, with respect to 100 wt parts of the toner particles.

Hereinafter, the configuration of the image forming apparatus according to an aspect of the invention will be described.

Figure 4:
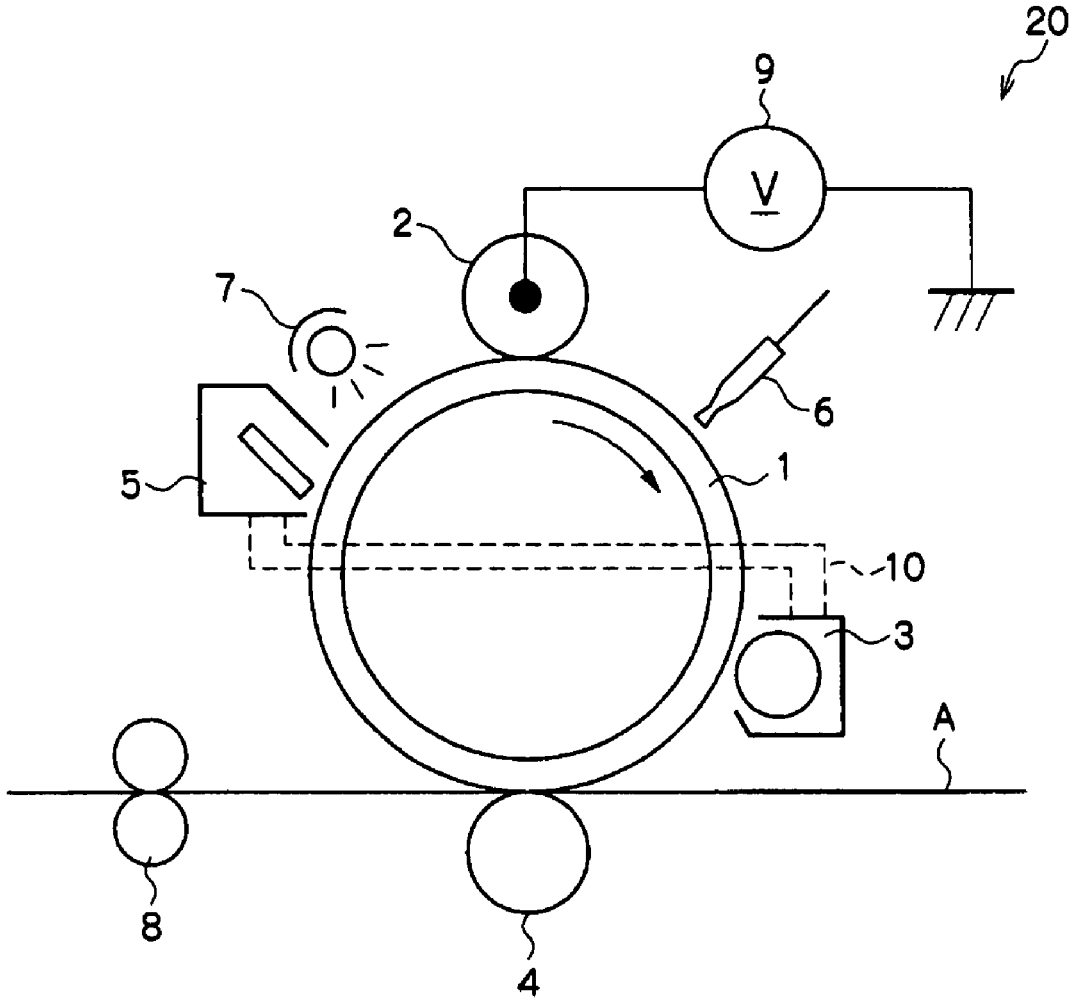
FIG. 4 is a schematic view illustrating the configuration of an image forming apparatus according to an aspect of the invention.

FIG. 4 is a schematic view illustrating the configuration of an image forming apparatus according to an aspect of the invention. The image forming apparatus 20 shown in FIG. 4 has an electrophotographic photosensitive body (latent image-holding member) 1, a contact-type electrostatically charging device 2 charging the electrophotographic photosensitive body 1, a power supply 9 applying a voltage to the contact-type electrostatically charging device 2, an exposure device 6 forming a latent image by photoirradiating the charged electrophotographic photosensitive body 1, a developing device (developing unit) 3 forming a toner image from the formed latent image with a developer containing a toner, a transfer device (transfer unit) 4 transferring the toner image formed by the developing device 3 onto a recording medium A, a cleaning device (cleaning unit) 5 removing the toner remaining on the electrophotographic photosensitive body 1 surface after transfer, a static charge-eliminating device 7 removing the electric potential remaining on the surface of the electrophotographic photosensitive body 1, a fixing device 8 fixing the toner image transferred to the recording medium A, for example, by heat and/or pressure, and a toner return pipe (recycling unit) 10 sending the residual toner removed by the cleaning device 5 back to the developing device 3 as recycled toner.

The developer according to the first or second invention described above is used as the developer.

The steps of forming an image in the image forming apparatus will be described briefly.

In the charging step, the contact-type electrostatically charging device 2 is used as electrification unit for charging the electrophotographic photosensitive body 1, and examples of the electrification unit include non-contact-type chargers such as Corotron and Scorotron, and contact-type chargers charging an electrophotographic photosensitive body by applying a voltage to a conductive part (volumetric resistivity: $10^{11}$ Ωcm or less, the same shall apply hereinafter) in contact with the surface of the electrophotographic photosensitive body, and any one of them may be used. However, a contact-electrification charging device is preferable, for environmental protection by reduction of ozone generation and improvement in printing durability.

The shape of the conductive part in the contact-electrification charging device is not particularly limited, and may be brush-shaped, blade-shaped, pin electrode-shaped, roller-shaped, or the like.

In the latent image formation step, a latent image is formed on the surface of the charged electrophotographic photosensitive body 1 by the exposure device 6. Examples of the exposure devices 6 for use include laser beam systems, light emitting diode arrays, and the like.

In the developing process, the latent image formed on the surface of the electrophotographic photosensitive body 1 is developed into a toner image with a developer containing a toner. The toner image is formed by bringing the toner into contact with the latent image formed on the surface of the electrophotographic photosensitive body 1, for example, by bringing a developer-holding member carrying a developer layer formed on the surface closer to the electrophotographic photosensitive body 1 and rotating it in the direction along the electrophotographic photosensitive body 1.

The developing method may be any one of known methods, but favorable developing methods by using a two-component developer include, but are not limited to, cascade systems, magnetic brush systems, and the like.

The developing unit has a developer holding member (so-called magnetic roll) holding the developer on the surface, and, in a favorable exemplary embodiment, the developer holding member preferably revolves along the electrophotographic photosensitive body (latent image-holding member) 1, supplying the developer to the electrophotographic photosensitive body 1.

The peripheral tip speed of the developer holding member is preferably in the range of approximately 200 to 800 mm/sec, more preferably 300 to 700 mm/sec. A magnetic-roll peripheral tip speed of lower than 200 mm/sec is unfavorable, as it is not suitable for the recent trend toward acceleration of processing and also unsatisfactory from the point of high-density reproducibility. On the other hand, a peripheral tip speed of higher than 800 mm/sec may lead to deformation of a trimmer (layer-forming member) by lower mechanical strength of the developing device and also to unsatisfactory density reproducibility because of the irregularity of the developer on the developer holding member, especially when the developer is used in a small developing machine.

In the transfer step, the toner image formed on the surface of the electrophotographic photosensitive body 1 is transferred onto a recording medium, forming a transferred image. In the transfer step shown in FIG. 1, the toner image is transferred directly onto an image-receiving member such as paper, but the toner image may be first transferred onto a drum- or belt-shaped intermediate transfer body and then retransferred onto a recording medium such as paper.

Corotron may be used as the transfer device of transferring the toner image of the electrophotographic photosensitive body 1, for example, onto paper. The Corotron is effective as a means of charging paper uniformly, but demands a high pressure of several kV, and thus a high-pressure power supply, for charging a recording medium paper to a particular degree. Corona discharge generates ozone, occasionally causing degradation of its rubber parts and the electrophotographic photosensitive body, and thus, preferable is a contact transfer method of transferring the toner image onto paper by pressing a conductive transfer roll of an elastic material onto the electrophotographic photosensitive body 1, but the transfer device in the image forming apparatus according to the invention is not particularly limited.

The toner, paper powder, dust, and others deposited on the surface are removed in the cleaning step, as a cleaning unit (cleaning blade) is brought into direct contact with the surface of the electrophotographic photosensitive body 1. A cleaning brush, a cleaning roll, or the like may be used as cleaning unit, replacing the cleaning blade.

Commonly used in the cleaning step is a blade cleaning method of pressing a rubber blade, for example of polyurethane, onto the electrophotographic photosensitive body. Alternatively, a magnetic brush method of recovering the toner by placing a fixed magnet inside and a rotable cylindrical nonmagnetic sleeve around its external surface, and making the sleeve surface carry a magnetic support or a method of removing the toner by placing a rotable roll of conductive resin fiber or animal hair and applying to the roll a bias voltage in the polarity opposite to that of the toner may be used. A Corotron for cleaning pretreatment may be installed, in the former magnetic brush method. The cleaning method is not particularly limited in the invention.

In the recycling step, the residual toner removed from the surface of the electrophotographic photosensitive body 1 in the cleaning step is send through a recycling means of toner return pipe 10 into the developing device 3 as recycled toner. A conveyer screw not shown in FIG. is installed in the toner return pipe 10, and the residual toner in the cleaning device 5 side of the toner return pipe 10 is send to the developing device 3 by revolution of the conveyer screw.

Examples of other recycling methods include a method of supplying the residual toner removed by the cleaning device into a refill toner inlet or a developing device by a conveyor, a method of mixing refill toner and recycled toner in an intermediate chamber and supplying the mixture into the developing device, and the like. Favorable is a method of supplying the recycling toner directly back into the developing device or a method of mixing refill toner and recycled toner in an intermediate chamber and supplying the mixture.

In the first invention, the total energy of the developer in the developing device of an image forming apparatus by the toner reclaim process, as determined by using a powder rheometer under the condition described above, is preferably in the range of 480 to 1,000 mJ, more preferably in the range of 500 to 920 mJ.

A total energy of less than 480 mJ may leads to decrease of frictional effect, prohibiting electrification of the toner to a degree needed for forming a favorable image. A total energy of more than 1,000 mJ may lead to deterioration in the fluidity of the entire developer, prohibiting electrification of the recycled toner to a degree needed for forming a favorable image.

Also in the second invention, the total energy of the developer in developing device of an image forming apparatus by the toner reclaim process, as determined by using a powder rheometer under the condition described above, is preferably in the range of 300 to 500 mJ, more preferably in the range of 340 to 440 mJ.

A total energy of less than 300 mJ may lead to decrease of frictional effect, prohibiting electrification of the recycled toner to a degree needed for forming a favorable image. A total energy of more than 500 mJ may lead to deterioration in the fluidity of the entire developer, prohibiting electrification of the recycled toner to a degree needed for forming a favorable image.

The developer is filled in the developing device in the state allowing image formation, and may not contain the recycled toner initially or may contain the recycled toner during use; the toner concentration in the developer is approximately 3.0 to approximately 15.0 wt %.

The toner image transferred on the recording medium A is fixed by the fixing device 8. A heat-fixing device having a heat roll is used favorably as the fixing device 8. The heat-fixing device has a heater lamp for heating in a cylindrical metal core, a fixing roller carrying a so-called release layer of heat-resistant resin or rubber layer on the peripheral surface, and a pressure roller or belt placed in contact with the fixing roller having a heat-resistant elastomer layer formed on the peripheral surface of the cylindrical metal core or the belt-shaped base material. The unfixed toner image is fixed by feeding a recording medium carrying an unfixed toner image into the space between the fixing roller and the pressure roller or between the fixing roller and the pressure belt, allowing fusion of the binder resin, additives, and others in the toner. In the invention, the fixing method is not particularly limited.

When a full-color image is desirably formed in the invention, favorably used is a method of forming toner images in various colors on the recording medium surface one by one (tandemly) by using multiple electrophotographic photosensitive bodies respectively having developing devices in various colors and by processing in a series of steps including latent image-formation step, developing process, transfer step and cleaning step and heat-fixing the full-color toner image thus superimposed in the fixing step.

In the image forming apparatus according to the invention, the electrophotographic photosensitive body may be integrated with at least one of the electrification unit, latent image formation means, developing unit, transfer unit, cleaning unit and recycling unit, forming a process cartridge, and used as a single unit detachable from the image forming apparatus, for example, by using a guiding means such as a rail for the apparatus.

Examples of the recording mediums receiving the toner image include plain paper and OHP sheet used in copying machine, printer, and others in the electrophotographic process, and the like. Alternatively, for example, coated paper carrying a resin layer on the surface, art paper for printing, or the like may be used.

EXAMPLES

Hereinafter, the invention will be described in detail with reference to Examples, but it should be understood that the invention is not limited by these Examples. "Part" and "%" below represent respectively "wt parts" and "wt %", unless specified otherwise.

<Method of Determining Various Properties>

First, the methods of determining the physical properties of the toner used in each Example and Comparative Example (excluding the methods described above) will be described.

(Method of Determining Molecular Weight and Molecular Weight Distribution of Resin)

The molecular weight and the molecular weight distribution of a polymerized resin are determined under the following condition: The GPC used is "HLC-8120GPC, SC-8020 (manufactured by Toso Corporation); the columns, TSK gel and Super HMH (manufactured by Toso Corporation, 6.0 mm ID×15 cm); and the eluant, THF (tetrahydrofuran). The sample concentration in the test is 0.5 wt %; the flow rate, 0.6 ml/min; the sample injection, 10 μl, the measurement temperature, 40° C.; and the detector, an IR detector. A calibration curve is prepared by using 10 polystyrene standard samples: "TSK Standards" manufactured by Tosoh Corp.: "A-500", "F-1", "F-10", "F-80", "F-380", "A-2500", "F-4", "F-40" "F-128", and "F-700".

(Volume-Average Diameter of Resin Particles, Colorant Particles, and Others)

The volume-average particle diameter of resin particles, colorant particles, or the like is determined by using a laser-diffraction distribution analyzer (manufactured by Horiba, Ltd., LA-700).

(Method of Determining Glass Transition Temperature of Resin)

The glass transition temperature (Tg) of a resin is determined according to ASTM D3418-8, as the intermediate temperature in the stepwise endothermic change, by measurement in a differential scanning calorimeter (DSC3110, Thermal Analysis System 001, manufactured by Mac-Science) under the condition of a programmed heating rate of 10° C./minute from 25° C. to 150° C.

(Method of Determining Toner Particle Diameter Distribution)

The toner particle diameter distribution is determined by using an analyzer Multisizer II (manufactured by Beckmann Coulter) and an aperture having a diameter of 100 μm. The electrolyte solution used is ISOTON-II (manufactured by Beckmann Coulter).

<Preparation of Toner>

(Preparation of dispersions)

-Resin Particle Dispersion-

A solution containing 370 parts of styrene, 30 parts of n-butyl acrylate, 8 parts of acrylic acid, 24 parts of dodecanethiol and 4 parts of carbon tetrabromide is added into a flask containing 6 parts of a nonionic surfactant (Nonipol 400, manufactured by Sanyo Chemical Industries Co., Ltd.) and 10 parts of an anionic surfactant (Neogen SC: manufactured by Dai-ichi Kogyo Seiyaku Co., Ltd.) dissolved in 550 parts of ion-exchange water; 50 parts ion-exchange water containing 4 parts of dissolved ammonium persulfate is added thereto; while the mixture is stirred gently over 10 minutes. After nitrogen substitution, the mixture is heated to 70° C. while the flask is shaken in an oil bath and kept at the same temperature for 5 hours, allowing progress of emulsion polymerization, to give a resin particle dispersion containing dispersed resin particles having a particle diameter of 150 nm, a Tg of 58° C., a weight-average molecule weight Mw of 11,500. The solid content concentration of the dispersion is 40%.

-Colorant Dispersion-

Carbon black (R330, manufactured by Cabot): 60 parts

Nonionic surfactant (Nonipol 400, manufactured by Sanyo Chemical Industries Co., Ltd.): 5 parts Ion-exchange water: 240 parts The components above are mixed and dispersed in a homogenizer (Ultra-Turrax T50, manufactured by IKA) for 10 minutes and then in Ultimizer for 10 minutes, to give a colorant dispersant containing dispersed colorant (carbon black) particles having a volume-average diameter of 250 nm.

-Releasing Agent Dispersion-

Paraffin wax (HNP0190, manufactured by Japan Seiro Co., Ltd., melting temperature: 85° C.): 100 parts Cationic surfactant (Sanisol B50, manufactured by Kao Corp.): 5 parts Ion-exchange water: 240 parts The components above are dispersed in a round stainless steel flask by using a homogenizer (Ultra-Turrax T50, manufactured by IKA) for 10 minutes and then in a high-pressure extrusion homogenizer, to give a releasing agent dispersion containing dispersed releasing agent particles having a volume-average diameter of 350 nm.

(Preparation of Black Toner (1))

Resin particle dispersion: 234 parts

Colorant dispersion: 30 parts

Releasing agent dispersion: 40 parts

Polyaluminum chloride (PAC 100 W, manufactured by Asada Chemicals): 1.8 parts

Ion-exchange water: 600 parts

The components above are mixed and dispersed in a round stainless steel flask by using a homogenizer (Ultra-Turrax T50, manufactured by IKA) and then heated in a heating oil bath, to an internal temperature of 52° C., while the mixture is stirred. The mixture is left at 52° C. for 120 minutes, and aggregate particles having a volume-average particle diameter D50 of 4.8 μm are generated.

Then, 32 parts of the resin particle dispersion is added to the dispersion containing the aggregate particles, and the mixture is heated in a heating oil bath gradually to a temperature of 53° C. and kept at the same temperature for 30 minutes. The dispersion containing the aggregate particles is adjusted to pH 5.0 by addition of aqueous 1 N sodium hydroxide solution; the stainless steel flask is sealed tightly, and heated to 95° C. while the dispersion is stirred with a magnetism seal and kept at the same temperature of 6 hours. After cooling, the toner particles are filtered, washed with ion-exchange water four times, and freeze-dried, to give black toner particles. The volume-average particle diameter D50 of the toner particles is 5.5 μm, and the shape factor SF1 is 120.

One part of titanium oxide (average primary particle diameter: 12 nm, previously treated with n-decyltrimethoxysilane) and 1.5 parts of monodispersion spherical silica (average primary particle diameter: 40 nm, previously treated with silicone oil) are added to 100 parts of the toner particles; the mixture is blended in a powder-processing apparatus (Nobilta NOB130, manufactured by Hosokawamicron) at a clearance of 3 mm and a peripheral tip speed of 1,500 rpm for 5 minutes; and bulky particles are removed by using a tube having openings of 45 μm in diameter, to give a black toner (1). The external-additive adhesiveness index SA of the toner is 80%.

(Preparation of Black Toner (2))

A black toner (2) is prepared in a similar manner to the black toner (1), except that Nobilta NOB130 (manufactured by Hosokawamicron) used in the external additive treatment in preparation of the black toner (1) is blended in a Henschel mill at 2,500 rpm for 10 minutes. The volume-average particle diameter D50 of the toner is 5.5 μm, and the external-additive adhesiveness index SA, 40%.

(Preparation of Black Toner (3))

A black toner (3) is prepared in a similar manner to the black toner (1), except that the heating in preparation of the black toner (1) is changed to 95° C. for 3 hours. The volume-average particle diameter D50 of the toner is 5.5 μm; the shape factor SF1 is 125; and the external-additive adhesiveness index SA is 85%.

(Preparation of Black Toner (4))

A black toner (4) is prepared in a similar manner to the black toner (1), except that the heating in preparation of the black toner (1) is changed to 95° C. for 1 hour. The volume-average particle diameter D50 of the toner is 5.5 μm, the shape factor SF1, 130; and the external-additive adhesiveness index SA, 90%.

Example 1

(Preparation of Developer)

Fine and coarse particles in ferrite particles (absolute specific gravity: 4.5, volume-average diameter: 35 μm, shape factor SF1: 125) are removed in an Elbow Jet (EJ-LABO, manufactured by Nittetsu Mining), to give magnetic particles for coating. As for the particle diameter distribution of the magnetic particles obtained, the coarse-particle-diameter distribution index is 1.18; the fine-particle-diameter distribution index, 1.20; the volume-average diameter, 37 μm; and the shape factor SF1, 124.

Twenty parts of a toluene solution containing a styrene-methylmethacrylate copolymer (solid content: 15%) is added to 100 parts of the magnetic particle, and the mixture is agitated in a 50-L batchwise jacketted kneader for 10 minutes and heated while agitated. Then, the mixture is stirred at a temperature of 120° C. or higher for 20 minutes and then allowed to cool to a mixture temperature of 60° C., to give a coated carrier. Then, fine/coarse particles are removed by repeating processing in an Elbow Jet (EJ-LABO, manufactured by Nittetsu Mining) thrice, to give a carrier (1).

As for the particle diameter distribution of the obtained carrier (1), the coarse-particle-diameter distribution index is 1.15; the fine-particle-diameter distribution index, 1.16; the volume-average diameter, 37 μm, and the shape factor SF1, 123. The total energy of the obtained carrier (1), as determined by the method described above by using a powder rheometer FT4 (manufactured by Freeman Technology), is 2,200 mJ.

A hundred parts of the carrier (1) and 8 parts of the toner (1) are blended in a V blender at 40 rpm for 20 minutes, to give a developer.

(Evaluation)

The following printing test is performed by using the obtained developer, in a modified test machine of Docu Centre f235G (Fuji Xerox Co., Ltd.) having a recycling mechanism shown in FIG. 4 at a magnetic-roll sleeve peripheral tip speed of 450 mm/sec.

The printing test is performed by printing an image on 100,000 sheets of paper at an area coverage (rate of image present on a sheet of recording paper) of 50.0% under a high-temperature high-humidity condition (28° C., 85% RH), and the transfer efficiency, the unevenness in density, and the toner staining are evaluated after printing on 10 sheets (initial) and 100,000 sheets according to the following evaluation methods. The developer sample is collected from the developing device after printing on 100,000 sheets of paper, and the total energy thereof is measured according to the method described above by using a powder rheometer.

-Evaluation of Transfer Efficiency-

A solid patch image of 5 cm×2 cm in size is developed; the toner image developing on the photosensitive body surface is transferred by using the tackiness of the tape surface; and the weight (W1) of the transferred image is measured. Then, the toner image developing when the development is repeated is transferred onto the surface of paper (J paper: manufactured by Fuji Xerox Office Supply), and the weight of the transferred image (W2) is measured. The transfer efficiency is calculated according to the following Formula (4) and evaluated.

$$\text{Transfer efficiency (\%)}=(W2/W1)\times 100 \qquad \text{Formula (4)}$$

The evaluation criteria for the transfer efficiency are as follows, and the ranks a and b are practical.

a: Transfer efficiency: 95% or more b: Transfer efficiency: 90% or more and less than 95% c: transfer efficiency: 85% or more and less than 90% d: Transfer efficiency: less than 85%

-Evaluation of Unevenness in Density-

A half tone image of 10 cm×5 cm in size is printed, and the image density is determined by using X-rite 404. The unevenness in image density is determined by measuring 10 points randomly and calculating the difference between the maximum and minimum values in density. The evaluation criteria for the unevenness in density are as follows, and the ranks a and b are practical.

a: Difference between maximum and minimum values: 0.03 or less b: Difference between maximum and minimum values: more than 0.03 and 0.05 or less c: Difference between maximum and minimum values: more than 0.05 and 0.10 or less d: Difference between maximum and minimum values: more than 0.10

-Evaluation of Toner Staining-

Staining of the charger, apparatus and printed sample is examined by visual observation. The evaluation criteria for toner staining evaluation are as follows, and the rank b is practical.

b: No staining on printed sample or charger or in apparatus.

c: Some staining on charger or in apparatus.

d: Some staining on printed sample or charger or in apparatus.

-Overall Rating-

The overall rating is determined according to the following evaluation criteria:

a: a or b in all evaluation items, and three or more a's b: a or b in all initial evaluation items, and one or more a's in evaluation after printing on 100,000 sheets.

c: two or more c's.

d: one or more d's

The evaluation results are summarized in Table 1.

Examples 2 to 4

Carriers (2), (3), and (4) are prepared in a similar manner to Example 1, except that removal of fine/coarse particles with an Elbow Jet is repeated two, four, and five times, instead of thrice in the preparation of the carrier in Example 1 after resin coating. Developers are prepared and evaluated in a similar manner to 1 by using the carriers (2) to (4). Results are summarized in Table 1.

Example 5

Fine and coarse particles in ferrite particles (absolute specific gravity: 4.5, volume-average diameter: 35 μm, shape factor SF1: 120) are removed with an Elbow Jet, to give magnetic particle for resin coating. As for the particle diameter distribution of the obtained magnetic particles, the coarse-particle-diameter distribution index is 1.18; the fine-particle-diameter distribution index, 1.20; the volume-average diameter, 37 μm; and the shape factor SF1, 118.

Sixty parts of a toluene solution containing a perfluoroacrylate copolymer (solid content: 5%) and 10 parts of a toluene solution containing a styrene methacrylate copolymer (solid content: 15%) are added to 100 parts of the magnetic particle, and the mixture is blended in a 50-L batchwise jacketted kneader for 10 minutes and heated while stirred. The mixture is then stirred at a temperature of 120° C. or higher for 20 minutes and allowed to cool to a mixture temperature of 60° C., and coarse particles are removed with a 75-μm sieve, to give a carrier (5).

A developer is prepared in a similar manner to Example 1, by using the carrier (5), and the properties thereof are evaluated. Results are summarized in Table 1.

Example 6

Styrene-butyl acrylate copolymer (component ratio: 80/20, Mw: $1.9\times10^5$): 30 parts Magnetite (EPT-1000, manufactured by Toda Kogyo Corp.): 100 parts The components above are melt-blended in a pressurized kneader and pulverized and rounded into spherical particles in a turbomill and a heat-treating apparatus, and fine and coarse particles therein are removed with an Elbow Jet (EJ-LABO, manufactured by Nittetsu Mining), to give magnetic powder-dispersed particles.

A hundred parts of the magnetic powder-dispersed particles are placed in a 50-L batchwise jacketted kneader and heated to 120° C. while stirred; 20 parts of a toluene solution containing a styrene-methacrylate copolymer (solid content: 15%) is sprayed thereon; the mixture is stirred continuously for 20 minutes, forming a coating layer; and classification with an Elbow Jet is performed four times, to give a carrier (6).

As for the particle diameter distribution of the obtained carrier (6), the coarse-particle-diameter distribution index is 1.17; the fine-particle-diameter distribution index, 1.19; the volume-average diameter, 33 μm; the shape factor SF1, 110; and the absolute specific gravity, 3.5.

A developer is prepared in a similar manner to Example 1, by using the carrier (6), and the properties thereof are evaluated. Results are summarized in Table 1.

Example 7

A carrier (7) is prepared in a similar manner to Example 6, except that the classification with the Elbow Jet in Example 6 is performed thrice.

A developer is prepared in a similar manner to Example 1, by using the carrier (7), and the properties thereof are evaluated. Results are summarized in Table 1.

Example 8

A carrier (8) is prepared in a similar manner to Example 6, except that the classification with the Elbow Jet in Example 6 is performed five times.

A developer is prepared in a similar manner to Example 1, by using the carrier (8), and the properties thereof are evaluated. Results are summarized in Table 1.

Example 9

A developer is prepared and evaluated in a similar manner to Example 1, except that the black toner (1) used in preparation of the developer of Example 1 is replaced with the black toner (3). Results are summarized in Table 1.

Example 10

A developer is prepared and evaluated in a similar manner to Example 1, except that the black toner (1) used in preparation of the developer of Example 1 is replaced with the black toner (4). Results are summarized in Table 1.

Example 11

A print test is performed in a similar manner to Example 1, except that the sleeve peripheral tip speed of the magnetic roll in the modified test machine of Docu Centre f235G (Fuji Xerox Co., Ltd.) in evaluation of Example 1 is changed to 900 mm/sec.

Results are summarized in Table 1.

Comparative Example 1

Ferrite particles (absolute specific gravity: 4.5, volume-average diameter: 35 μm, shape factor SF1: 125) are used as they are without classification. Twenty parts of a toluene solution containing a styrene-methacrylate copolymer (solid content: 15%) is added to 100 parts of the ferrite particles; the mixture is agitated in 50-L batchwise jacketted kneader for 10 minutes, allowing temperature rise, and additionally at a temperature of 120° C. or higher for 20 minutes; and the mixture is allowed to cool to a temperature of 60° C., to give a resin-coated carrier. Then, coarse particles are removed with a 75-μm sieve, to give a carrier (9). The total energy of the carrier (9) obtained is 3,690 mJ.

A hundred parts of the carrier (9) and 8 parts of the black toner (2) are blended in a V blender at 40 rpm for 20 minutes, to give a developer.

Various tests are performed according to Example 1, by using the developer. Results are summarized in Table 1.

Comparative Examples 2 to 3

Carriers (10) and (11) are prepared in a manner similar to Comparative Example 1, except that fine/coarse particles are removed with an Elbow Jet once and twice, instead of the removal of coarse particles with a 75-μm sieve in Comparative Example 1.

100 parts of respective carriers (10) and (11) and 8 parts of the toner (2) are blended in a V blender at 40 rpm for 20 minutes, to give respective developers. Various tests are performed according to Example 1, by using the developers. Results are summarized in Table 1.

Comparative Example 4

Fine and coarse particles in ferrite particles (absolute specific gravity: 4.5, volume-average diameter: 35 μm, shape factor SF1: 110) are removed with an Elbow Jet, to give magnetic particles for resin coating. As for the particle diameter distribution of the obtained magnetic particle, the coarse-particle-diameter distribution index is 1.18; the fine-particle-diameter distribution index, 1.20; the volume-average diameter, 37 μm; and the shape factor SF1, 109.

Sixty parts of a toluene solution containing a perfluoroacrylate copolymer (solid content: 5%) and 10 parts of a toluene solution containing a styrene-methacrylate copolymer (solid content: 15%) are added to 100 parts of the magnetic particles above, and the mixture is agitated in a 50-L batchwise jacketted kneader for 10 minutes, allowing temperature rise during agitation. The mixture is then agitated at a temperature of 120° C. or higher for 20 minutes and allowed to cool to a mixture temperature of 60° C., to give a carrier (12).

A hundred parts of the carrier (12) and 8 parts of the black toner (2) are blended in a V blender at 40 rpm for 20 minutes, to give a developer.

Various tests are performed according to Example 1, by using the developer. Results are summarized in Table 1.

Comparative Example 5

A carrier (13) is prepared in a similar manner to Example 6, except that the classification with the Elbow Jet in Example 6 is performed twice.

A hundred parts of the carrier (13) and 8 parts of the black toner (2) are blended in a V blender at 40 rpm for 20 minutes, to give a developer. Various tests are performed according to Example 1, by using the developer. Results are summarized in Table 1.

Comparative Example 6

A carrier (14) is prepared in a similar manner to Example 6, except that the styrene-methacrylate copolymer used in preparation of the magnetic powder-dispersed particles in Example 6 is replaced with a perfluoroacrylate copolymer.

A hundred parts of the carrier (14) and 8 parts of the toner (2) are blended in a V blender at 40 rpm for 20 minutes, to give a developer. Various tests are performed according to Example 1, by using the developer. Results are summarized in Table 1.

Comparative Example 7

A hundred parts of the carrier (11) prepared in Comparative Example 3 and 8 parts of the toner (1) are blended in a V blender at 40 rpm for 20 minutes, to give a developer.

Various tests are performed according to Example 1, by using the developer. Results are summarized in Table 1.

Comparative Example 8

A hundred parts of the carrier (12) prepared in Comparative Example 4 and 8 parts of the toner (1) are blended in a V blender at 40 rpm for 20 minutes, to give a developer.

Various tests are performed according to Example 1, by using the developer. Results are summarized in Table 1.

Comparative Example 9

A hundred parts of the carrier (1) prepared in Comparative Example 1 and 8 parts of the toner (2) are blended in a V blender at 40 rpm for 20 minutes, to give a developer.

Various tests are performed according to Example 1, by using the developer. Results are summarized in Table 1.

TABLE 1

| | Toner | | | Carrier | | Total energy of | | Initial | | |
|---|---|---|---|---|---|---|---|---|---|---|
| | | External-additive | | | Total | developing | Peripheral | | | |
| | No. | adhesiveness index SA (%) | SF1 | No. | energy (mJ) | solution (mJ) | tip speed (mm/sec) | Transfer efficiency | Unevenness in density | Toner staining |
| Example 1 | (1) | 80 | 120 | (1) | 2200 | 750 | 450 | a | a | b |
| Example 2 | (1) | 80 | 120 | (2) | 2910 | 990 | 450 | b | b | b |
| Example 3 | (1) | 80 | 120 | (3) | 1800 | 620 | 450 | a | a | b |
| Example 4 | (1) | 80 | 120 | (4) | 1420 | 490 | 450 | b | b | b |
| Example 5 | (1) | 80 | 120 | (5) | 2190 | 750 | 450 | a | a | b |
| Example 6 | (1) | 80 | 120 | (6) | 1100 | 375 | 450 | a | a | b |
| Example 7 | (1) | 80 | 120 | (7) | 1390 | 480 | 450 | b | b | b |
| Example 8 | (1) | 80 | 120 | (8) | 890 | 300 | 450 | b | b | b |
| Example 9 | (3) | 85 | 125 | (1) | 2200 | 750 | 450 | b | b | b |
| Example 10 | (4) | 90 | 130 | (1) | 2200 | 745 | 450 | b | b | b |
| Example 11 | (1) | 80 | 120 | (1) | 2200 | 755 | 900 | b | b | b |
| Comparative Example 1 | (2) | 40 | 120 | (9) | 3690 | 1260 | 450 | b | b | b |
| Comparative Example 2 | (2) | 40 | 120 | (10) | 3400 | 1160 | 450 | b | b | b |
| Comparative Example 3 | (2) | 40 | 120 | (11) | 2950 | 1010 | 450 | b | b | b |
| Comparative Example 4 | (2) | 40 | 120 | (12) | 1330 | 450 | 450 | b | b | b |
| Comparative Example 5 | (2) | 40 | 120 | (13) | 1420 | 510 | 450 | b | b | b |
| Comparative Example 6 | (2) | 40 | 120 | (14) | 840 | 280 | 450 | b | b | b |
| Comparative Example 7 | (1) | 80 | 120 | (11) | 2950 | 1010 | 450 | b | b | b |
| Comparative Example 8 | (1) | 80 | 120 | (12) | 1330 | 460 | 450 | b | b | b |
| Comparative Example 9 | (2) | 40 | 120 | (1) | 2200 | 800 | 450 | b | b | b |

| | After printing on 100,000 sheets | | | |
|---|---|---|---|---|
| | Transfer efficiency | Unevenness in density | Toner staining | Overall rating |
| Example 1 | a | a | b | a |
| Example 2 | b | b | b | b |
| Example 3 | b | b | b | b |
| Example 4 | b | b | b | b |
| Example 5 | b | a | b | a |
| Example 6 | b | a | b | a |
| Example 7 | b | b | b | b |
| Example 8 | b | b | b | b |
| Example 9 | b | b | b | b |
| Example 10 | c | b | b | b |
| Example 11 | b | c | b | b |
| Comparative Example 1 | d | d | d | d |
| Comparative Example 2 | d | c | d | d |
| Comparative Example 3 | c | c | c | c |
| Comparative Example 4 | c | c | c | c |
| Comparative Example 5 | c | d | c | d |
| Comparative Example 6 | c | c | b | c |
| Comparative Example 7 | b | c | c | c |
| Comparative Example 8 | b | c | c | c |

TABLE 1-continued

| | | | | |
|---|---|---|---|---|
| Comparative Example 9 | b | c | c | c |

As shown in Table 1, the recycled toner and the refill toner obtained in Examples, in which a carrier having a total energy, as determined with a powder rheometer under the condition above, in a favorable range described above is used, are charged favorably, giving an image uniform in density and definite without blurring or toner scattering.

Hereinafter, other embodiments of the invention will be described.

(1). An image forming apparatus, comprising: a latent image-holding member; a developing unit that develops a latent image formed on the latent image-holding member into a toner image with a developer; a transfer unit that transfers the toner image formed on the latent image-holding member onto a recording medium; a cleaning unit that cleans off residual toner remaining on the latent image-holding member after transfer; and a recycling unit that recycles the cleaned residual toner by feeding it to the developing unit; and the developer comprising a toner having an external-additive adhesiveness index SA in the range of approximately 50% to approximately 95% and a carrier satisfying any one of the following conditions (A) or (B):

(A) the carrier includes magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,420 to approximately 2,920 mJ; or (B) the carrier includes contains magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 890 to approximately 1,390 mJ.

(2) An image forming apparatus of (1), wherein the carrier further satisfies any one of the following conditions (C) or (D):

(C) the carrier includes magnetic particles and a coating layer coating the surface of the magnetic particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,500 to approximately 2,700 mJ; or (D) the carrier includes magnetic powder-dispersed particles and a coating layer coating the surface of the magnetic powder-dispersed particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,000 to approximately 1,300 mJ.

(3) An image forming apparatus of (1), wherein the developer satisfies any one of the following conditions (E) or (F):

(E) the developer contains a toner having an external-additive adhesiveness index SA in the range of approximately 50% to approximately 95% and a carrier containing magnetic particles and a coating layer coating the surface of the magnetic particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 480 to approximately 1,000 mJ; or (F) the developer contains a toner having an external-additive adhesiveness index SA in the range of approximately 50% to approximately 95% and a carrier containing magnetic powder-dispersed particles and a coating layer coating the surface of the magnetic powder-dispersed particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 300 to approximately 500 mJ.

(4) An image forming apparatus of (1), wherein the shape factor SF1 of the toner is in the range of approximately 100 to approximately 125.

(5) An image forming apparatus of (2), wherein the shape factor SF1 of the toner is in the range of approximately 100 to approximately 125.

(6) An image forming apparatus of (3), wherein the shape factor SF1 of the toner is in the range of approximately 100 to approximately 125.

(7) An image forming apparatus of (1), wherein the developing unit has a developer holding member rotating and facing the image carrier, and the peripheral tip speed of the developer holding member is in the range of approximately 200 to approximately 800 mm/sec.

(8) An image forming apparatus of (2), wherein the developing unit has a developer holding member rotating and facing the image carrier, and the peripheral tip speed of the developer holding member is in the range of approximately 200 to approximately 800 mm/sec.

(9) An image forming apparatus of (3), wherein the developing unit has a developer holding member rotating and facing the image carrier, and the peripheral tip speed of the developer holding member is in the range of approximately 200 to approximately 800 mm/sec.

(10) A carrier for electrostatic image development, comprising magnetic particles and a coating layer coating the surface of the magnetic particles, wherein the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,420 to approximately 2,920 mJ.

(11) The carrier for electrostatic image development of (10), comprising magnetic particles and a coating layer coating the surface of the magnetic particles, wherein the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,500 to approximately 2,700 mJ.

(12) A carrier for electrostatic image development, comprising magnetic powder-dispersed particles and a coating layer coating the surface of the magnetic powder-dispersed particles, wherein the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 890 to approximately 1,390 mJ.

(13) The carrier for electrostatic image development of (12), comprising magnetic powder-dispersed particles and a coating layer coating the surface of the magnetic powder-dispersed particles, wherein the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,000 to approximately 1,300 mJ.

(14) An image-forming method, comprising: developing a latent image formed on a latent image-holding member into a toner image with a developer, transferring the toner image formed on the latent image-holding member onto a recording medium, cleaning the toner remaining on the latent image-holding member after transfer, and recycling the cleaned residual toner by feeding it into the developing unit, and the developer comprising a toner having an external-additive adhesiveness index SA in the range of approximately 50% to approximately 95% and a carrier satisfying any one of the following conditions (A) or (B):

(A) the carrier includes magnetic particles and a coating layer coating the surface of the magnetic particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,420 to approximately 2,920 mJ; or (B) the carrier includes magnetic powder-dispersed particles and a coating layer coating the surface of the magnetic powder-dispersed particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 890 to approximately 1,390 mJ.

(15) The image-forming method of (14), wherein the carrier satisfies any one of the following conditions (C) or (D):

(C) the carrier includes magnetic particles and a coating layer coating the surface of the magnetic particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,500 to approximately 2,700 mJ; or (D) the carrier includes magnetic powder-dispersed particles and a coating layer coating the surface of the magnetic powder-dispersed particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 1,000 to approximately 1,300 mJ.

(16) The image-forming method of (14), wherein the developer satisfies any one of the following conditions (E) or (F):

(E) the developer contains a toner having an external-additive adhesiveness index SA in the range of approximately 50% to approximately 95% and a carrier containing magnetic particles and a coating layer coating the surface of the magnetic particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 480 to approximately 1,000 mJ; or (F) the developer contains a toner having an external-additive adhesiveness index SA in the range of approximately 50% to approximately 95% and a carrier containing magnetic powder-dispersed particles and a coating layer coating the surface of the magnetic powder-dispersed particles, and the total energy thereof, as determined with a powder rheometer under the condition of a ventilation rate of 10 ml/min, a rotor-blade peripheral tip speed of 100 mm/s, and a rotor-blade angle of approach of −10°, is in the range of approximately 300 to approximately 500 mJ.

(17) The image-forming method of (14), wherein the shape factor SF1 of the toner is in the range of approximately 100 to approximately 125.

(18) The image-forming method of (14), wherein the developing unit has a developer holding member rotating and facing the image carrier, and the peripheral tip speed of the developer holding member is in the range of approximately 200 to approximately 800 mm/sec.

What is claimed is:

1. An image forming apparatus, comprising: a latent image-holding member; a developing unit that develops a latent image formed on the latent image-holding member into a toner image with a developer; a transfer unit that transfers the toner image formed on the latent image-holding member onto a recording medium; a cleaning unit that cleans off residual toner remaining on the latent image-holding member after transfer; and a recycling unit that recycles the cleaned residual toner by feeding it to the developing unit; and the developer comprising a toner having an external-additive adhesiveness index SA in the range of approximately 50% to approximately 95% and a carrier satisfying any one of the following conditions (A) or (B):

(A) the carrier includes magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,420 to approximately 2,920 mJ; or (B) the carrier includes magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 890 to approximately 1,390 mJ.

2. The image forming apparatus of claim 1, wherein the carrier further satisfies any one of the following conditions (C) or (D):

(C) the carrier includes magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,500 to approximately 2,700 mJ; or (D) the carrier includes magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,000 to approximately 1,300 mJ.

3. The image forming apparatus of claim 2, wherein the shape factor SF1 of the toner is in the range of approximately 100 to approximately 125.

4. The image forming apparatus of claim 2, wherein the developing unit has a developer holding member rotating and facing the latent image holding member, and the peripheral tip speed of the developer holding member is in the range of approximately 200 to approximately 800 mm/sec.

5. The image forming apparatus of claim 1, wherein the carrier further satisfies any one of the following conditions (E) or (F):

(E) the developer includes a toner having an external-additive adhesiveness index SA in the range of approximately 50% to approximately 95% and a carrier containing magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 480 to approximately 1,000 mJ; or (F) the developer includes a toner having an external-additive adhesiveness index SA in the range of approximately 50% to approximately 95% and a carrier containing magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach −10°, is in the range of approximately 300 to approximately 500 mJ.

6. The image forming apparatus of claim 5, wherein the shape factor SF1 of the toner is in the range of approximately 100 to approximately 125.

7. The image forming apparatus of claim 5, wherein the developing unit has a developer holding member rotating and facing the latent image holding member, and the peripheral tip speed of the developer holding member is in the range of approximately 200 to approximately 800 mm/sec.

8. The image forming apparatus of claim 1, wherein the shape factor SF1 of the toner is in the range of approximately 100 to approximately 125.

9. The image forming apparatus of claim 1, wherein the developing unit has a developer holding member rotating and facing the latent image holding member , and the peripheral tip speed of the developer holding member is in the range of approximately 200 to approximately 800 mm/sec.

10. A carrier for electrostatic image development, comprising magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,420 to approximately 2,920 mJ.

11. The carrier for electrostatic image development of claim 10, comprising magnetic particles and a coating layer coating the surface of the magnetic particles, wherein the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,500 to approximately 2,700 mJ.

12. A carrier for electrostatic image development, comprising magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 890 to approximately 1,390 mJ.

13. The carrier for electrostatic image development of claim 12, comprising magnetic powder-dispersed particles and a coating layer coating the surface of the magnetic powder-dispersed particles, wherein the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,000 to approximately 1,300 mJ.

14. An image-forming method, comprising:

developing a latent image formed on a latent image-holding member into a toner image with a developer, transferring the toner image formed on the latent image-holding member onto a recording medium, cleaning off residual toner remaining on the latent image-holding member after transfer, and recycling the cleaned residual toner by feeding it into the developing unit, and the developer includes a toner having an external-additive adhesiveness index SA in the range of approximately 50% to approximately 95% and a carrier satisfying any one of the following conditions (A) or (B):

(A) the carrier includes magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,420 to approximately 2,920 mJ; or (B) the carrier includes magnetic powder-dispersed particles and a coating layer coating the surface of the magnetic powder-dispersed particles, and the total energy of the carrier, as determined with a powder rheometer under the condition of a ventilation rate of 10 ml/min, a rotor-blade peripheral tip speed of 100 mm/s, and a rotor-blade angle of approach of −10°, in the range of approximately 890 to approximately 1,390 mJ.

15. The image-forming method of claim 14, wherein the carrier further satisfies any one of the following conditions (C) or (D):

(C) the carrier includes magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,500 to approximately 2,700 mJ; or (D) the carrier includes magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 1,000 to approximately 1,300 mJ.

16. The image-forming method of claim 14, wherein the carrier further satisfies any one of the following conditions (E) or (F):

(E) the developer comprises a toner having an external-additive adhesiveness index SA in the range of approximately 50% to approximately 95% and a carrier including magnetic particles and a coating layer coating the surface of the magnetic particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 480 to approximately 1,000 mJ; or (F) the developer comprises a toner having an external-additive adhesiveness index SA in the range of approximately 50% to approximately 95% and a carrier including magnetic powder-dispersed particles and a coating layer coating the surface of the magnetic powder-dispersed particles, and the total energy of the carrier, as determined with a powder rheometer under the conditions of a ventilation rate of 10 ml/min, a rotor-blade peripheral tip speed of 100 mm/s, and a rotor-blade angle of approach of −10°, is in the range of approximately 300 to approximately 500 mJ.

17. The image-forming method of claim 14, wherein the shape factor SF1 of the toner is in the range of approximately 100 to approximately 125.

18. The image-forming method of claim 14, wherein the developing unit has a developer holding member rotating and facing the latent image holding member, and the developer holding member has a peripheral tip speed of in the range of approximately 200 to approximately 800 mm/sec.

* * * * *